US006261992B1

(12) United States Patent
Furuya et al.

(10) Patent No.: US 6,261,992 B1
(45) Date of Patent: Jul. 17, 2001

(54) REVERSIBLE THERMOSENSITIVE RECORDING MATERIAL AND RECORDING METHOD AND APPARATUS THEREFOR

(75) Inventors: Hiromi Furuya; Masaru Shimada; Tadafumi Tatewaki, all of Shizuoka-ken; Masafumi Torii; Fumio Kawamura, both of Sizuoka; Hiroaki Matsui, Numazu, all of (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/406,069

(22) Filed: Sep. 24, 1999

(30) Foreign Application Priority Data

Sep. 29, 1998 (JP) ..... 10-290125
Oct. 16, 1998 (JP) ..... 10-309520

(51) Int. Cl.[7] ..... B41M 5/30

(52) U.S. Cl. ..... 503/201; 346/135.1; 503/208; 503/209

(58) Field of Search ..... 346/135.1; 503/201, 503/208, 209

(56) References Cited

U.S. PATENT DOCUMENTS

| | | | |
|---|---|---|---|
| 5,198,836 | 3/1993 | Saito et al. | 346/76 PH |
| 5,380,693 | 1/1995 | Goto | 503/200 |
| 5,403,810 | 4/1995 | Sawamura et al. | 503/201 |
| 5,447,900 | 9/1995 | Suzaki et al. | 503/207 |
| 5,482,912 | 1/1996 | Furuya et al. | 503/207 |

(List continued on next page.)

FOREIGN PATENT DOCUMENTS

| | | |
|---|---|---|
| 60-193691 | 10/1985 | (JP) . |
| 61-237684 | 10/1986 | (JP) . |
| 62-138556 | 6/1987 | (JP) . |
| 62-138568 | 6/1987 | (JP) . |
| 62-140881 | 6/1987 | (JP) . |
| 63-173684 | 7/1988 | (JP) . |

(List continued on next page.)

*Primary Examiner*—Bruce H. Hess
(74) *Attorney, Agent, or Firm*—Cooper & Dunham LLP

(57) ABSTRACT

A reversible thermosensitive recording material which includes a recording layer including an electron donating coloring agent and an electron accepting coloring developer and in which an image is reversibly formed and erased by appropriately heating and cooling the recording layer, wherein the recording layer further includes an erasure promoter including one or more secondary amide group having the following formulas (1), (2) or (3):

(1)

(2)

(3)

wherein each of R1, R2, R3, R4 and R5 independently represents a hydrocarbon group which is optionally substituted and which may be saturated or unsaturated, and wherein R1 and R2 are optionally combined to form a ring which may include one or more of a nitrogen atom, an oxygen atom and a sulfur atom. Alternatively, the erasure promoter may include two or more secondary amide groups having formula (1), (2) or (3).

17 Claims, 1 Drawing Sheet

U.S. PATENT DOCUMENTS

| | | | |
|---|---|---|---|
| 5,489,501 | 2/1996 | Torii et al. | 430/341 |
| 5,521,138 | 5/1996 | Shimada et al. | 503/209 |
| 5,532,201 | 7/1996 | Goto | 503/213 |
| 5,547,500 | 8/1996 | Tsutsui | 106/21 A |
| 5,622,909 | 4/1997 | Furuya et al. | 503/216 |
| 5,641,724 | 6/1997 | Yamaguchi et al. | 503/221 |
| 5,663,115 | 9/1997 | Naito et al. | 503/201 |
| 5,703,005 | 12/1997 | Torii et al. | 503/201 |
| 5,716,477 | 2/1998 | Yamaguchi et al. | 156/230 |
| 5,739,077 | 4/1998 | Goto et al. | 503/200 |
| 5,741,752 | 4/1998 | Goto et al. | 503/221 |
| 5,891,823 | 4/1999 | Torii et al. | 503/216 |

FOREIGN PATENT DOCUMENTS

| | | |
|---|---|---|
| 2188293 | 7/1990 | (JP) . |
| 2188294 | 7/1990 | (JP) . |
| 5124360 | 5/1993 | (JP) . |
| 6210954 | 8/1994 | (JP) . |
| 6340171 | 12/1994 | (JP) . |
| 7052542 | 2/1995 | (JP) . |
| 7068933 | 3/1995 | (JP) . |
| 8132735 | 5/1996 | (JP) . |
| 8156410 | 6/1996 | (JP) . |
| 8310128 | 11/1996 | (JP) . |
| 9270563 | 10/1997 | (JP) . |
| 9272262 | 10/1997 | (JP) . |
| 8300820 | 11/1997 | (JP) . |
| 9300817 | 11/1997 | (JP) . |

REVERSIBLE THERMOSENSITIVE RECORDING MATERIAL AND RECORDING METHOD AND APPARATUS THEREFOR

BACKGROUND OF THE INVENTION

1. Field of the Invention

The present invention relates to a reversible thermosensitive recording material, and a recording method therefor, and more particularly to a reversible thermosensitive recording material which utilizes a coloring reaction of an electron donating coloring agent and an electron accepting color developer and in which a colored image is repeatedly formed and erased by appropriately heating and cooling the reversible thermosensitive recording material, and a recording method and apparatus therefor.

2. Discussion of the Related Art

A variety of thermosensitive recording materials are well known in which a colored image can be formed by a coloring reaction when an electron donating coloring agent is brought into contact with an electron accepting color developer while heat or the like is applied thereto.

The thermosensitive recording materials have the following advantages over other conventional recording materials:

(1) color images can be rapidly recorded by a relatively simple apparatus without using such complicated steps as developing and fixing;

(2) color images can be recorded without producing noise and environmental pollution;

(3) various color images, e.g., red, blue, violet and black, can be easily obtained;

(4) image density and background whiteness are high; and (5) the manufacturing cost is relatively low. Because of these advantages, the above-described thermosensitive recording materials can be widely used, not only as a recording material for price labels in stores, but also as recording materials for copiers, facsimiles, automatic vending machines of tickets, video printers and printers for computers and measuring instruments.

However, the coloring reaction of these thermosensitive recording materials is irreversible and accordingly these recording materials cannot be repeatedly used.

Several thermosensitive recording materials which can reversibly form and erase an image have been proposed. For example, they are as follows:

(1) a thermosensitive recording material which includes gallic acid in combination with phloroglucinol serving as coloring developers (Japanese Laid-Open Patent Publication No. 60-193691);

(2) a thermosensitive recording material which includes phenolphthalein or Thymolphthalein serving as a coloring developer (Japanese Laid-Open Patent Publication No. 61-237684);

(3) a thermosensitive recording material which includes an uniform solid solution of a coloring agent, a coloring developer and a carboxylic acid ester (Japanese Laid-Open Patent Publications No. 62-138556, 62-138568 and 62-140881);

(4) a thermosensitive recording material which includes an ascorbic acid derivative serving as a coloring developer (Japanese Laid-Open Patent Publication No. 63-173684); and (5) a thermosensitive recording material which includes bis(hydroxyphenyl)acetic acid or a higher aliphatic amine salt of gallic acid serving as a coloring developer (Japanese Laid-Open Patent Publications Nos. 2-188293 and 2-188294).

Some of the present inventors, jointly with others, have proposed a reversible thermosensitive coloring composition which includes a coloring agent such as a leuco dye and a color developer such as an organic phosphate compound, an aliphatic carboxylic acid compound or a phenolic compound each of which has a long-chain aliphatic hydrocarbon group, and a reversible thermosensitive recording material using the coloring composition (Japanese Laid-Open Patent Publication No. 5-124360). The reversible thermosensitive recording material can stably repeat image formation and image erasure by being appropriately heated and cooled, and the image-recorded state or the image-erased state can be stably maintained at room temperature. In addition, Japanese Laid-Open Patent Publication No. 6-210954 has disclosed a reversible thermosensitive recording material which includes a specified phenolic compound having a long-chain aliphatic hydrocarbon group serving as a color developer.

Japanese Laid-Open Patent Publications Nos. 7-52542, 7-68933, 8-132735, 8-310128, 9-272262, 9-270563, 9-300817 and 9-300820 have disclosed techniques in which quick erasability can be achieved by using a specified erasure promoter. However, the techniques have drawbacks in that the erasing properties are not satisfactory.

Because of these reasons, a need exists for a reversible thermosensitive recording material which has quick erasability, as well as good coloring properties and good preservation properties.

SUMMARY OF THE INVENTION

Accordingly, an object of the present invention is to provide a reversible thermosensitive recording material which has quick erasability.

Another object of the present invention is to provide a dreversible thermosensitive recording material in which recorded images have good preservation property.

The invention also embraces a recording method and apparatus using such a reversible thermosensitive recording material.

To achieve such objects, the present invention contemplates the provision of a reversible thermosensitive recording material which includes a recording layer including a reversible thermosensitive coloring composition including an electron donating coloring agent and an electron accepting color developer and in which an image is reversibly formed and erased by appropriately heating and cooling the recording layer, wherein the recording layer further includes an erasure promoter having one or more secondary amide group having a formula selected from the group consisting of the following formula (1), (2) and (3):

(1)

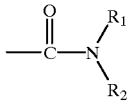

(2)

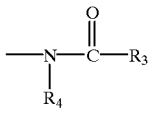

-continued (3)

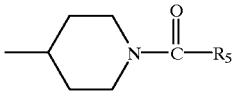

wherein each of R1–R5 independently represents a saturated or unsaturated hydrocarbon group which is optionally substituted, and wherein R1 and R2 are optionally combined to form a ring which may include a nitrogen atom, an oxygen atom or a sulfur atom.

At this point, "a secondary amide group" means an amide group in which the nitrogen atom is substituted by two substituents.

The erasure promoter preferably includes an alkyl chain having 6 or more carbon atoms and the secondary amide group.

The erasure promoter preferably includes a group having an association ability (a group capable of forming an associated state). The group having an association ability preferably has a formula selected from the group consisting of the following groups (4), (5) and (6):

(4)

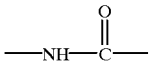

(5)

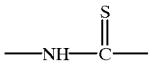

(6)

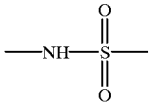

The erasure promoter preferably includes two or more secondary amide groups having formula (1), (2) or (3).

The compound having two or more secondary amide groups having formula (1), (2) or (3) preferably has the following formula (4'), (5') or (6').

(4')

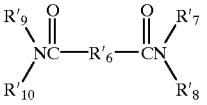

(5')

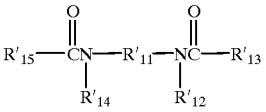

(6')

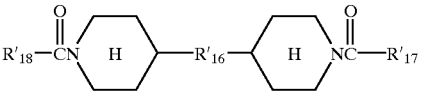

wherein each of R6'–R18' independently represents a hydrocarbon group which is optionally substituted and which may be saturated or unsaturated, and wherein R7' and R8', and R9' and R10' are independently and optionally combined to form a ring which may include one or more of a nitrogen atom, an oxygen atom and a sulfur atom.

In another aspect of the present invention, a reversible thermal image recording method for the reversible thermosensitive recording material is provided, including the steps of recording by imagewise heating the recording layer of the recording material of the present invention at a temperature not lower than an image forming temperature to form a colored image in the recording material and erasing by heating the colored image at a temperature lower than the image forming temperature and not lower than an image erasing temperature.

In yet another aspect of the present invention, a reversible thermal image recording apparatus for the reversible thermosensitive recording material is provided which includes an image forming device which imagewise heats the recording layer of the recording material at a temperature not lower than an image forming temperature to form an image in the recording layer when the recording layer is cooled, and an image erasing device which heats the recording layer at a temperature lower than the image forming temperature and not lower than an image erasing temperature to erase the image, wherein the image erasing device is selected from the group consisting of ceramic heaters, plane heaters, and heat rollers.

These and other objects, features and advantages of the present invention will become apparent upon consideration of the following description of the preferred embodiments of the present invention taken in conjunction with the accompanying drawing.

DESCRIPTION OF THE PREFERRED EMBODIMENTS

Figure 1:
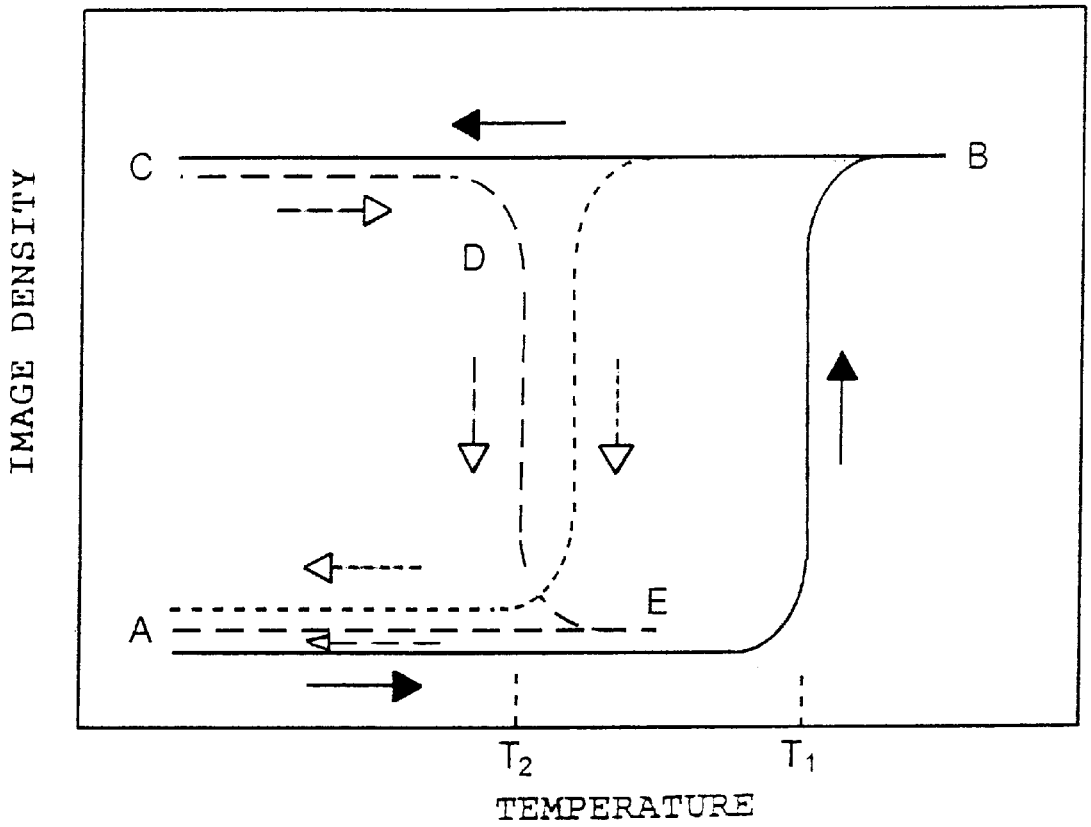
FIG. 1 is a graph illustrating the relationship between temperature and image density of a recording layer in an image recording and erasing cycle of an embodiment of the reversible thermosensitive recording material of the present invention.

FIG. 1 is a graph illustrating the relationship between temperature of a reversible thermosensitive recording material (hereinafter a recording material) and image density thereof. When the recording material which is in a non-colored state A is heated, the recording material begins to color at an image forming temperature T1 in which at least one of an electron donating coloring agent and an electron accepting coloring developer is melted and then achieves a melted colored state B. If the recording material in the melted colored state B is rapidly cooled to room temperature, the recording material keeps the colored state and achieves a cooled colored state C in which the electron donating coloring agent and the electron accepting color developer are almost solidified. It depends upon cooling speed whether the recording material remains in the colored state, and if the recording material is gradually cooled, the recording material returns to the non-colored state A (a dotted line B-A) or achieves a semi-colored state in which the image density of the recording material is relatively low compared to the image density of the recording material in the cooled colored state C. If the recording material in the cooled colored state C is heated again, the recording material begins to discolor at an image erasing temperature T2 lower than T1 and achieves a non-colored state E (a broken line C-D-E). If the recording material in the non-colored state E is cooled to room temperature, the recording material returns to the non-colored state A. The temperatures T1 and T2 depend on the materials of the coloring agent and the coloring developer. Accordingly, by appropriately selecting a coloring agent and a coloring developer, a recording material having desired T1 and T2 can be obtained. The image densities of the recording material in the colored states B and C are not necessarily the same.

In the colored state C, the recording layer includes the coloring agent and the color developer which form a solid in which a molecule of the coloring agent and a molecule of the color developer are mixed while contacting with each other. Namely, the coloring agent and the color developer cohere while they are reacting with each other, resulting in maintenance of the colored state. It is considered that the colored state C is stable because the semi-stable cohered structure of the coloring agent and the color developer is formed. On the other hand, in the non-colored state, at least one of the coloring agent and the color developer aggregates to form a domain, or crystallizes; thereby each phase of the coloring agent and the coloring developer which has a stable adhered structure is isolated from the other, and accordingly the recording material is stably in the non-colored state. In the recording materials of the present invention, the cohered structure of the coloring agent and the color developer is changed to a state in which the phases of the coloring agent and the color developer are isolated from the other and the coloring developer crystallizes; thereby color erasure can be perfectly performed. Namely, in the color erasure process of going from the colored state B to the non-colored state A when the recording materials are gradually cooled or going from the colored state C to the non-colored state A via the states D and E in FIG. 1, this structure change occurs at the image erasing temperature T2. The more stable the semi-stable cohered structure and the stable cohered structure of a recording material, the better the preservation properties of formed images and the erasability of the recording material.

The reversible thermosensitive recording material of the present invention has a substrate, a recording layer formed on the substrate and optionally a protective layer formed on the recording layer. The structure of the recording material of the present invention need not be limited to this structure. For example, the recording material may include an undercoat layer formed between the substrate and the recording layer, an intermediate layer formed between the recording layer and the protective layer, a layer including an ultraviolet absorbent formed overlying the recording layer and a backcoat layer formed on the side of the substrate opposite to the side on which the recording layer is formed. In addition, the recording material may include a magnetic recording layer, a print layer and the like. Further the recording material may be laminated on another substrate.

The present invention provides a reversible thermosensitive recording material which includes a recording layer which includes an electron donating coloring agent and an electron accepting color developer and which is formed overlying a substrate, wherein the recording layer achieves a colored state when heated at a temperature not lower than an image forming temperature and then cooled at a cooling speed, and the recording layer in the colored state achieves a non-colored state when heated at a temperature lower than the image forming temperature and not lower than an image erasing temperature, or when heated at a temperature not lower than the image forming temperature and then cooled at a cooling speed relatively slow compared to the first-mentioned cooling speed, and wherein the recording layer further includes an erasure promoter having one or more secondary amide groups having the following formula (1), (2) or (3):

(1)

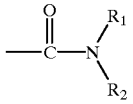

(2)

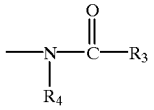

(3)

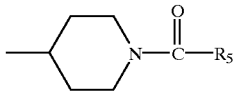

wherein each of R1–R5 independently represents a saturated or unsaturated hydrocarbon group which is optionally substituted, and wherein R1 and R2 are optionally combined to form a ring which may include a nitrogen atom, an oxygen atom or a sulfur atom.

Suitable hydrocarbon groups, which are optionally substituted, for use in R1–R5 include linear and branched hydrocarbon groups. In addition, the hydrocarbon groups may include a group such as —O—, —S—, —CO—, or —COO—. Further, the hydrocarbon groups may also include an aromatic ring or aliphatic ring. Furthermore, these hydrocarbon groups may be substituted with a hydroxy group, a halogen atom and/or the like.

The erasure promoter preferably has an alkyl chain having 6 or more carbon atoms and one or more of the secondary amide groups.

Specific examples of the alkyl chain having 6 or more carbon atoms include the groups shown in Table 1. In Table 1, n, n', n", n'" and n"" are 0 or an integer of from 1 to 22, and the numbers thereof are determined so that the resultant alkyl or alkylene chain has 6 or more carbon atoms.

TABLE 1

| | |
|---|---|
| $—(CH_2)nCH_3$ | $—(CH_2)nC(CH_3)_2—(CH_2)n'CH_3$ |
| $—(CH_2)nCH(CH_3)—(CH_2)n'CH_3$ | $—(CH_2)nCH=CH(CH_2)n'—CH_3$ |

TABLE 1-continued
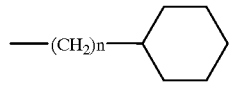
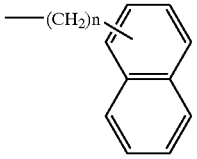
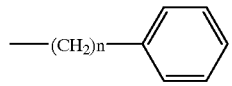
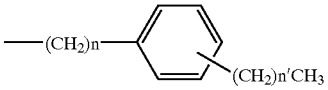
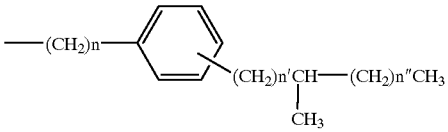
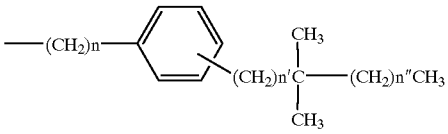
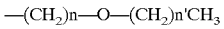
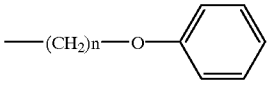
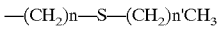
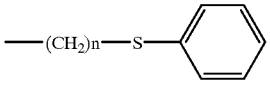
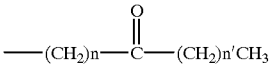
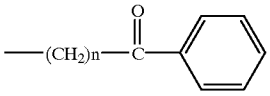
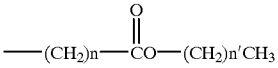
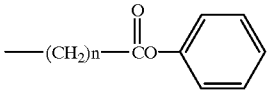
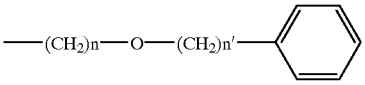
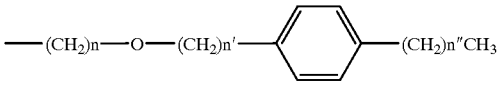
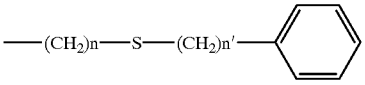
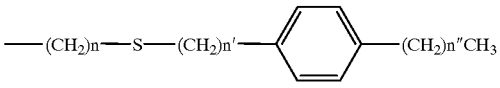
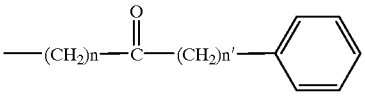
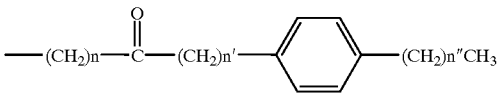
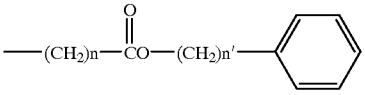
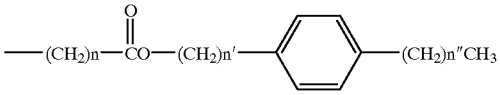
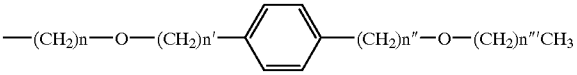

TABLE 1-continued

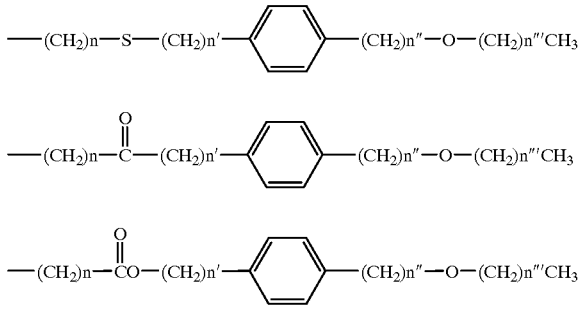

When R1 and R2 form a ring, specific examples of the group formed by R1 and R2 include the groups as shown in Table 2.

TABLE 2

| | | |
|---|---|---|
| —$(CH_2)_n$— | —$(CH_2)_n$—O—$(CH_2)_{n'}$— | —$(CH_2)_n$—N—$(CH_2)_{n'}$— |

In Table 2, n and n' are independently an integer of from 1 to 22.

The groups shown in Table 2 may be substituted with a hydroxy group and/or a halogen atom.

Specific examples of the suitable erasure promoter for use in the present invention include groups as shown in Table 3, but the erasure promoter of the present invention is not limited thereto.

TABLE 3

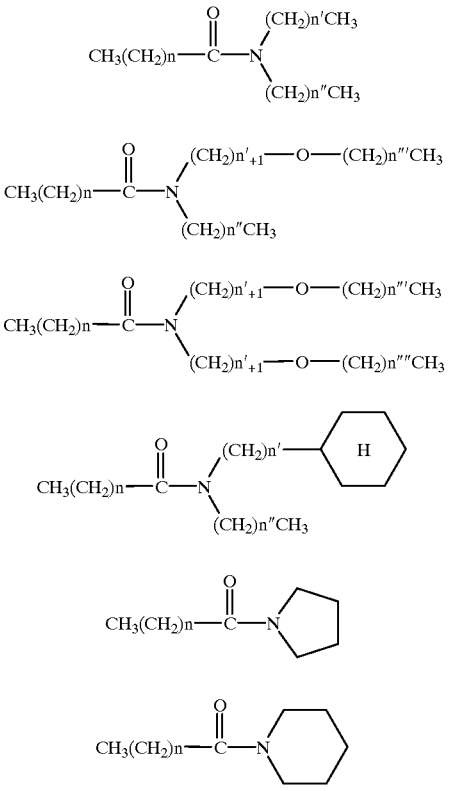

TABLE 3-continued

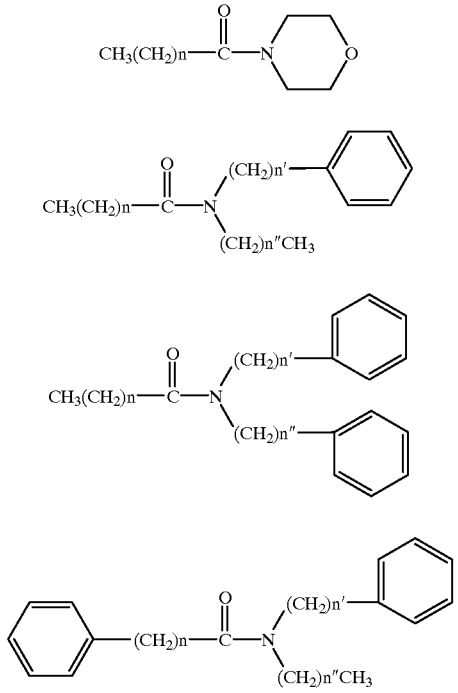

In Table 3, n, n', n", n"' and n"" are 0 or an integer of from 1 to 22, wherein at least one of them is not less than 5.

The erasure promoter of the present invention preferably has at least one group having an association ability to impart good preservation properties to the images formed in the recording material. The group having an association ability for use in the present invention include groups as shown in Table 4.

TABLE 4

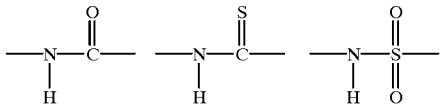

Specific examples of the groups having an association ability for use in the erasure promoter in the present invention include groups as shown in Table 5.

TABLE 5

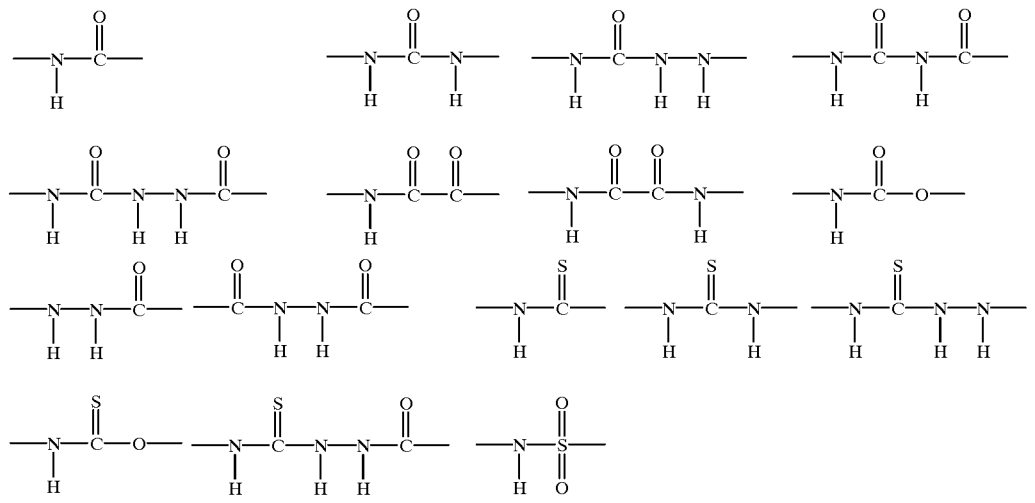

Specific examples of the erasure promoter including a secondary amide group, an alkyl chain having 6 or more carbon atoms, and a group having an association ability for use in the present invention include compounds as shown in Table 6, but the erasure promoter of the present invention is not limited thereto.

TABLE 6

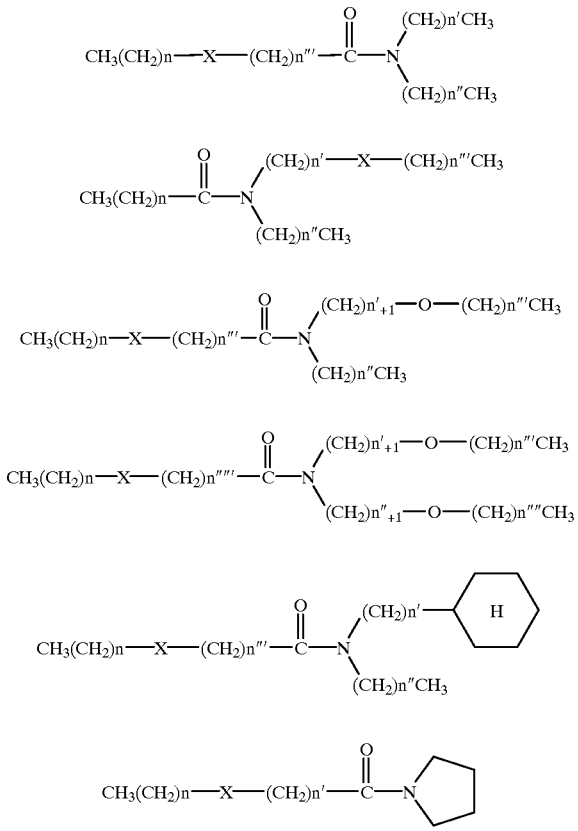

TABLE 6-continued

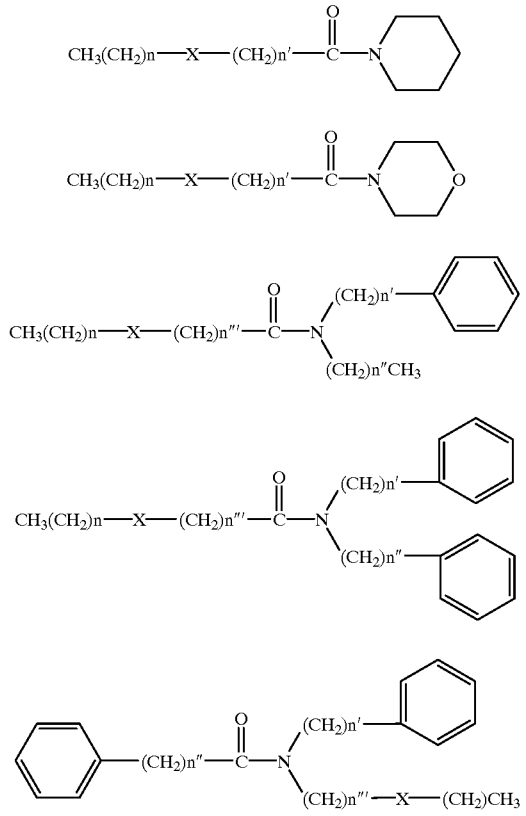

wherein X represents a group having an association ability; and n, n', n" and n"' are independently 0 or an integer of from 1 to 22, wherein at least one of them is not less than 5.

When an erasure promoter including two or more groups having an association ability is used, the resultant recording material has better image stability.

Specific examples of the erasure promoter which has two or more groups having an association ability and which has the following formula (7) shown in Table 6, which is shown in Table 6, include compounds having the following formula (8).

(7)

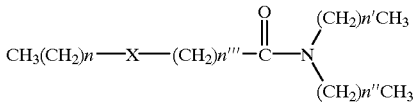

(8)

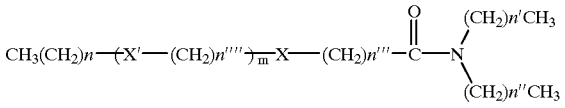

wherein X and X' represents a group having an association ability; n"" is 0 or an integer of from 1 to 22; and m is an integer of from 1 to 4, and when m is two or more, each of repeated X' is the same or different from each other, and each of repeated $(CH_2)_{n''''}$ is the same or different from each other.

Similarly, the compounds shown in Table 6 other than the compound having formula (7) can also have two or more groups having an association ability.

Specific examples of the erasure promoter having formula (7) and (8) include compounds as shown in Table 7, but the erasure promoter is not limited thereto. In addition, specific examples of the compounds shown in Tables 3 and 6 other than the compounds having formulas (7) and (8) include compounds similar to those shown in Table 7.

TABLE 7

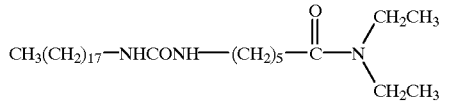

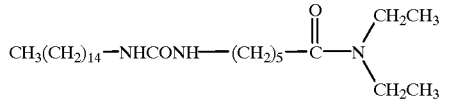

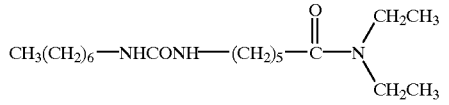

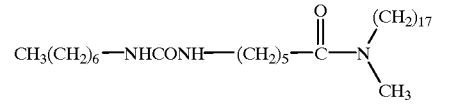

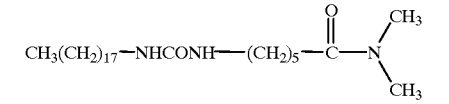

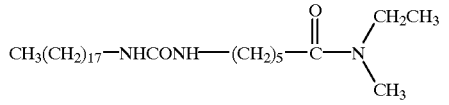

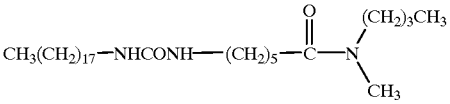

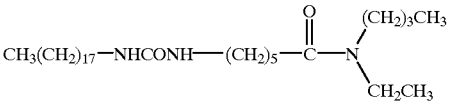

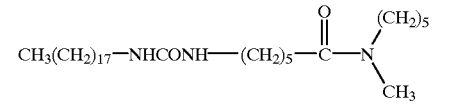

TABLE 7-continued
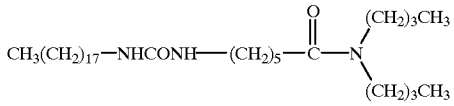
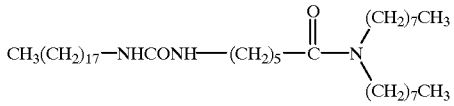
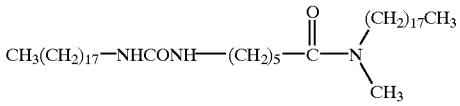
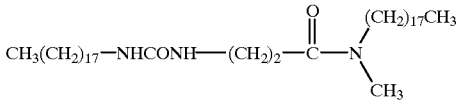
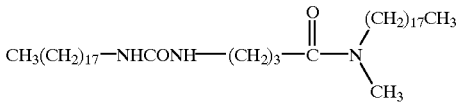
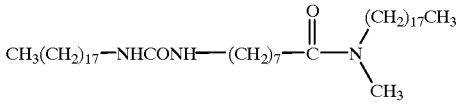
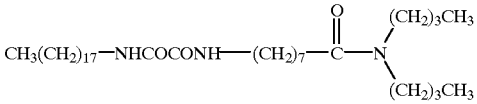
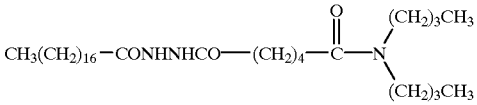
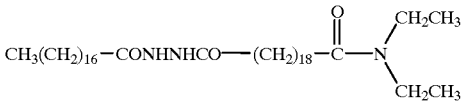
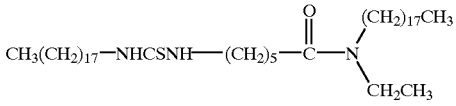
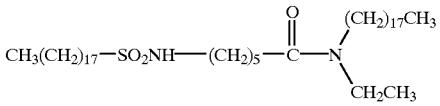
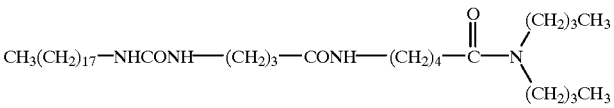

TABLE 7-continued

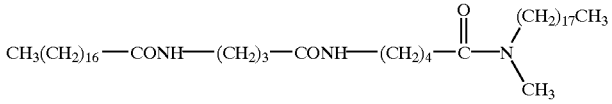

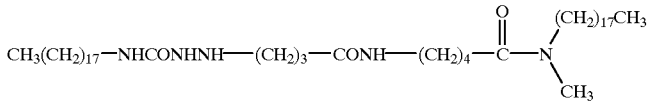

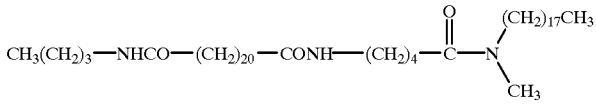

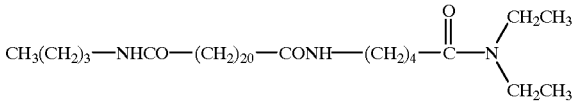

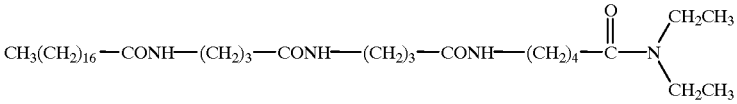

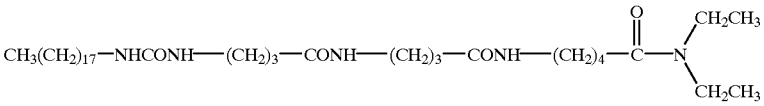

Alternatively, the erasure promoter of the present invention may include a compound having two or more secondary amide groups having formula (1), (2) or (3). By using such a compound as an erasure promoter, quick erasability can be obtained. Preferably, the compound has the following formula (4'), (5') or (6'):

(4')

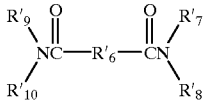

(5')

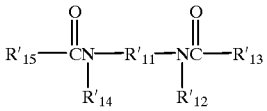

(6')

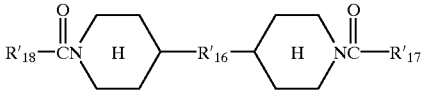

wherein R6' –R18' independently represent a hydrocarbon group which is optionally substituted and which may be saturated or unsaturated, wherein R7' and R8', and/or R9, and R10' are optionally combined to form a ring which may include a hetero atom such as a nitrogen atom, an oxygen atom and a sulfur atom.

Suitable groups for use as group R6', R11' and R16' include groups as shown in Table 8.

TABLE 8

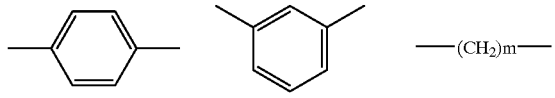

wherein m is an integer.

Suitable groups for use as group R7', R8', R9', R10', R12', R13', R14', R15', R17' and R18' include groups as shown in Table 9.

TABLE 9
| | |
|---|---|
| $-(CH_2)_mCH_3$ | $-(CH_2)mCH{=}CH(CH_2)m'CH_3$ |
| $-(CH_2)m-C_6H_4-(CH_2)m'CH_3$ | $-(CH_2)m-C_6H_{11}-(CH_2)m'CH_3$ |
| $-(CH_2)m-C_6H_4-(CH_2)m-C_6H_{11}$ | $-(CH_2)m-C(CH_2)m'''CH_3)(CH_2)m'CH_3)(CH_2)m''CH_3$ |
wherein m, m', m" and m'" are independently 0 or an integer of from 1 to 22.
Specific examples of the compound including two or more secondary amide groups having formula (4') include groups as shown in Table 10, but the compound is not limited thereto.
TABLE 10
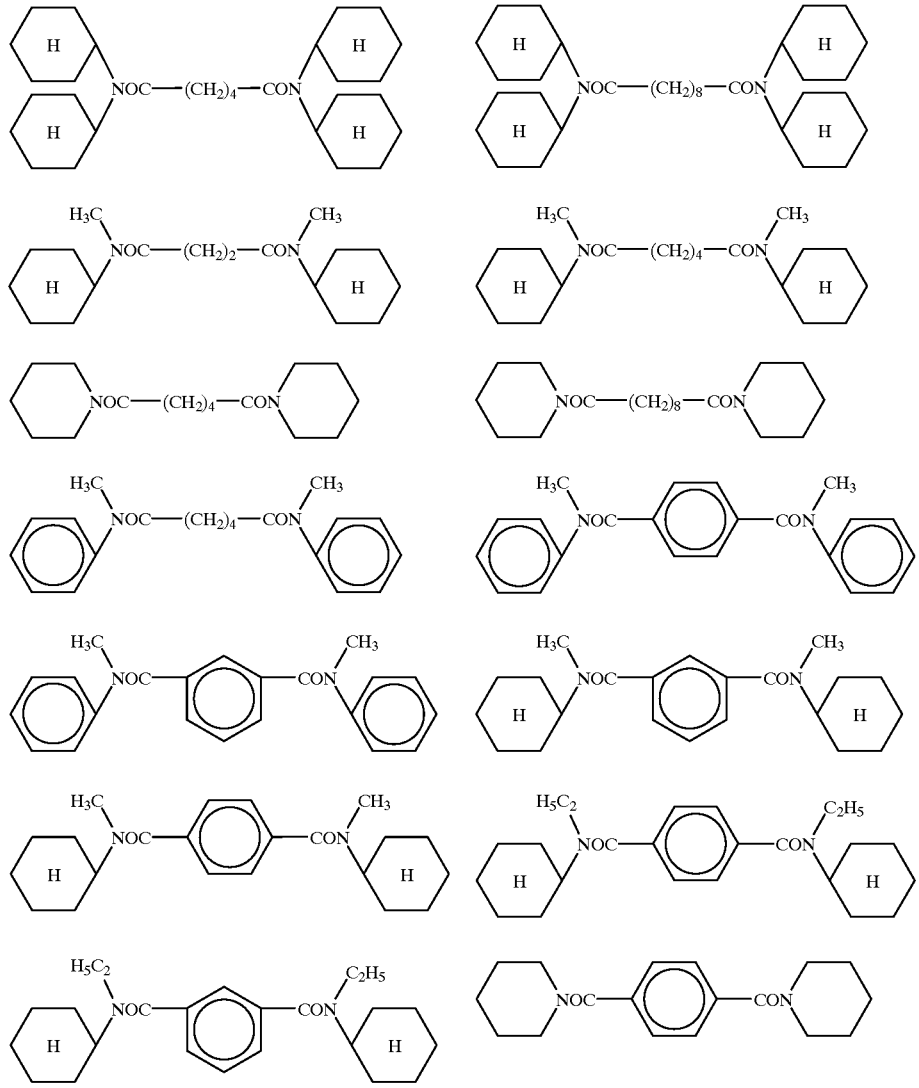

TABLE 10-continued
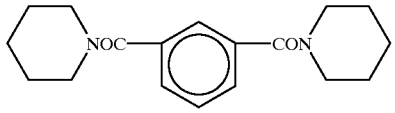
Specific examples of the compound having two or more secondary amide groups having formula (5') or (6') include groups respectively shown in Table 11 or 12, but the compound is not limited thereto.
TABLE 11
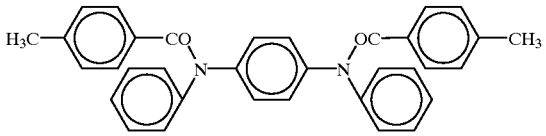
TABLE 11-continued
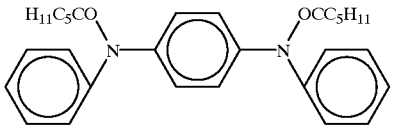
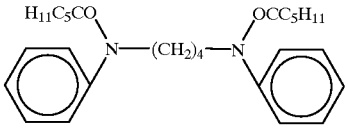
TABLE 12
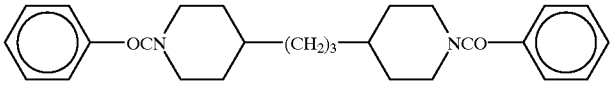
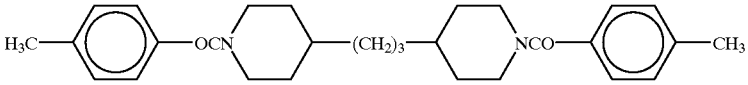
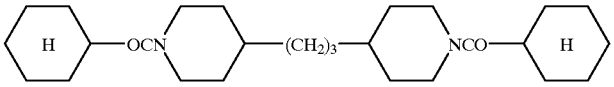
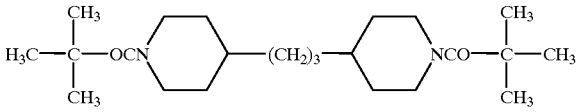
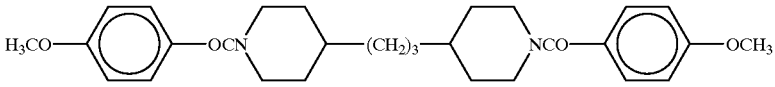
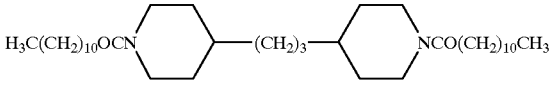
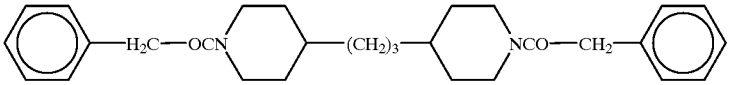

The reason for the improvement of erasability of the recording material is considered to be that the secondary amide group in the erasure promoter of the present invention interacts with a coloring agent and a color developer. In addition, it is considered that when the erasure promoter has a group having an association ability, the erasure promoter and a color developer form a stable aggregate; thereby recorded images have good color formation stability.

The recording layer of the recording material of the present invention preferably includes a compound having a divalent group including a hetero atom and an alkyl chain having 6 or more carbon atoms as a color formation/erasure controlling agent. By using such a color formation/erasure controlling agent together with the erasure promoter mentioned above, better color formation and erasure properties can be obtained.

Specific examples of the color formation/erasure controlling agent include compounds having the following formula (9) or (10).

$$R19—X1—R20 \quad (9)$$

$$R19—X1—R21—X1'—R20 \quad (10)$$

wherein X1, and X1' independently represent a divalent group including a hetero atom; R19, R20, and R21 independently represent a hydrocarbon group having from 1 to 22 carbon atoms.

The total of the carbon atoms included in R19, R20, and R21 is preferably not less than 8, and more preferably not less than 11, to obtain a recording material having good color formation stability and good erasing properties.

Groups R19, R20, and R21 independently represent a hydrocarbon group which may be substituted and which may be an aliphatic hydrocarbon group or an aromatic hydrocarbon group, or a group including an aliphatic hydrocarbon group and an aromatic hydrocarbon group. In addition, the aliphatic hydrocarbon group may be linear or branched, and may include an unsaturated bond. Further, the hydrocarbon group may include a substituent such as a hydroxy group, a halogen atom, an alkoxy group and the like.

Groups X1 and X1' include at least one of the groups as shown in Table 13.

TABLE 13

| | | | | |
|---|---|---|---|---|
| —NH— | —CO— | —O— | —S— | —$SO_2$— |

Specific examples of group X1 and X1' include groups as shown in Table 14.

TABLE 14

| —NH— | —CO— | —O— | —S— | —$SO_2$— |
|---|---|---|---|---|
| 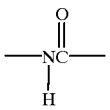 | 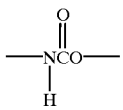 | 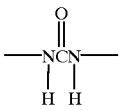 | 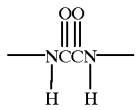 | 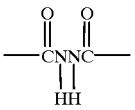 |
| 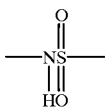 | 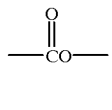 | 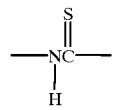 | 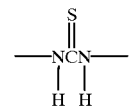 | 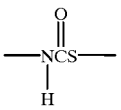 |

Suitable color formation/erasure controlling agents include compounds as shown in Table 15, but the color formation/erasure controlling agent is not limited thereto.

TABLE 15

| |
|---|
| $CH_3(CH_2)q—NHCONH—(CH_2)q'CH_3$ |
| $CH_3(CH_2)q—NHCO—(CH_2)q'CH_3$ |
| $CH_3(CH_2)q—NHCOCONH—(CH_2)q'CH_3$ |
| $CH_3(CH_2)q—NHCONHNH—(CH_2)q'CH_3$ |
| $CH_3(CH_2)q—NHSO_2NH—(CH_2)q'CH_3$ |
| $CH_3(CH_2)q—NHCOO—(CH_2)q'CH_3$ |
| $CH_3(CH_2)q—NHCO—(CH_2)q''—NHCONH—(CH_2)q'''CH_3$ |
| $CH_3(CH_2)q—OCO—(CH_2)q''—NHCONH—(CH_2)q'''CH_3$ |
| $CH_3(CH_2)q—O—(CH_2)q''—NHCONH—(CH_2)q'''CH_3$ |
| $CH_3(CH_2)q—NHNHCO—(CH_2)q''—NHCONH—(CH_2)q'''CH_3$ |
| $CH_3(CH_2)q—NHSO_2—(CH_2)q''—NHCONH—(CH_2)q'''CH_3$ |
| $CH_3(CH_2)q—NHCONH—(CH_2)q''—NHCONH—(CH_2)q'''CH_3$ |
| $CH_3(CH_2)q—NHCOO—(CH_2)q''—NHCONH—(CH_2)q'''CH_3$ |
| $CH_3(CH_2)q—NHCO—(CH_2)q''—NHCO—(CH_2)q'''CH_3$ |
| $CH_3(CH_2)q—OCO—(CH_2)q''—NHCO—(CH_2)q'''CH_3$ |
| $CH_3(CH_2)q—O—(CH_2)q''—NHCO—(CH_2)q'''CH_3$ |
| $CH_3(CH_2)q—NHNHCO—(CH_2)q''—NHCO—(CH_2)q'''CH_3$ |
| $CH_3(CH_2)q—NHSO_2—(CH_2)q''—NHCO—(CH_2)q'''CH_3$ |
| $CH_3(CH_2)q—NHCONH—(CH_2)q''—NHCO—(CH_2)q'''CH_3$ |
| $CH_3(CH_2)q—NHCOCONH—(CH_2)q''—NHCO—(CH_2)q'''CH_3$ |
| $CH_3(CH_2)q—NHCOO—(CH_2)q''—NHCO—(CH_2)q'''CH_3$ |
| $CH_3(CH_2)q—NHCO—(CH_2)q''—CONH—(CH_2)q'''CH_3$ |
| $CH_3(CH_2)q—NHCOO—(CH_2)q''—OCONH—(CH_2)q'''CH_3$ |
| $CH_3(CH_2)q—OCONH—(CH_2)q''—NHCOO—(CH_2)q'''CH_3$ |

In Table 15, q, q' and q" are independently an integer of from 1 to 22.

Specific examples of the compound having the following formula (11) or (12), which is shown in Table 15, include compounds as shown in Table 16.

$$CH_3(CH_2)q—NHCONH—CH_2)q'CH_3 \quad (11)$$

$$CH_3(CH_2)q—NHCONH—(CH_2)q''—NHCONH—(CH_2)q'''CH_3 \quad (12)$$

Specific examples of the compounds shown in Table 15 other than the compound having formula (11) or (12) include compounds similar to those shown in Table 16.

TABLE 16

| |
|---|
| $CH_3(CH_2)_{17}—NHCONH—CH_3$ |
| $CH_3(CH_2)_{17}—NHCONH—(CH_2)_2CH_3$ |
| $CH_3(CH_2)_{17}—NHCONH—(CH_2)_3CH_3$ |
| $CH_3(CH_2)_{17}—NHCONH—(CH_2)_4CH_3$ |
| $CH_3(CH_2)_{17}—NHCONH—(CH_2)_5CH_3$ |
| $CH_3(CH_2)_{17}—NHCONH—(CH_2)_6CH_3$ |
| $CH_3(CH_2)_{17}—NHCONH—(CH_2)_{11}CH_3$ |
| $CH_3(CH_2)_{17}—NHCONH—(CH_2)_{14}CH_3$ |
| $CH_3(CH_2)_{17}—NHCONH—(CH_2)_{17}CH_3$ |

TABLE 16-continued

| |
|---|
| $CH_3(CH_2)_{17}$—NHCONH—$(CH_2)_{21}CH_3$ |
| $CH_3(CH_2)_7$—NHCONH—$CH_2CH_3$ |
| $CH_3(CH_2)_7$—NHCONH—$(CH_2)_5CH_3$ |
| $CH_3(CH_2)_{21}$—NHCONH—$(CH_2)_3CH_3$ |
| $CH_3(CH_2)_{21}$—NHCONH—$(CH_2)_8CH_3$ |
| $CH_3(CH_2)_{21}$—NHCONH—$(CH_2)_{14}CH_3$ |
| $CH_3(CH_2)_{21}$—NHCONH—$(CH_2)_{21}CH_3$ |
| $CH_3(CH_2)_{17}$—NHCONH—$(CH_2)_{12}$—NHCONH—$(CH_2)_{17}CH_3$ |
| $CH_3(CH_2)_{17}$—NHCONH—$(CH_2)_6$—NHCONH—$(CH_2)_{17}CH_3$ |
| $CH_3(CH_2)_{17}$—NHCONH—$(CH_2)_2$—NHCONH—$(CH_2)_{17}$ |
| $CH_3(CH_2)_{21}$—NHCONH—$(CH_2)_6$—NHCONH—$(CH_2)_{21}CH_3$ |
| $CH_3(CH_2)_{21}$—NHCONH—$(CH_2)_{12}$—NHCONH—$(CH_2)_{21}CH_3$ |
| $CH_3(CH_2)_{21}$—NHCONH—$(CH_2)_6$—NHCONH—$(CH_2)_{21}CH_3$ |
| $CH_3(CH_2)_{21}$—NHCONH—$(CH_2)_3$—NHCONH—$(CH_2)_{21}CH_3$ |
| $CH_3$—NHCONH—$(CH_2)_{12}$—NHCONH—$CH_3$ |
| $CH_3(CH_2)_2$—NHCONH—$(CH_2)_{18}$—NHCONH—$(CH_2)_2CH_3$ |
| $CH_3$—NHCONH—$(CH_2)_6$—NHCONH—$(CH_2)_{17}CH_3$ |
| $CH_3(CH_2)_5$—NHCONH—$(CH_2)_6$—NHCONH—$(CH_2)_5CH_3$ |
| $CH_3(CH_2)_5$—NHCONH—$(CH_2)_{12}$—NHCONH—$(CH_2)_5CH_3$ |

The present inventors discover that when a recording material is repeatedly used, i.e., image recording and image erasing operations are performed many times, the recording layer is damaged most seriously. Therefore, it is discovered that by improving the heat resistance of the recording layer, the durability of the recording material can be improved.

In addition, the present inventors discover that by including a crosslinked resin in the recording layer, the heat resistivity of the recording layer can be improved, resulting in improvement of durability of the resultant recording material. In addition, by forming a protective layer including a crosslinked resin on the recording layer, the durability of the recording material can further be enhanced.

A crosslinked resin can be formed, for example, by heating a mixture of a crosslinking agent and a crosslinkable resin having an active group which can react with the crosslinking agent upon application of heat.

Specific examples of such a heat-crosslinkable resin include resins having an active group such as a hydroxy group, a carboxy group and the like, e.g., phenoxy resins, polyvinyl butyral resins, cellulose acetate propionate and cellulose acetate butyrate. In addition, a copolymer of a monomer having an active group such as a hydroxy group, a carboxyl group and the like with another monomer such as vinyl chloride, an acrylic monomer, styrene or the like can be employed. Specific examples of such a copolymer include vinyl chloride-vinyl acetate-vinyl alcohol copolymers, vinyl chloride-vinyl acetate-hydroxypropyl acrylate copolymers, vinyl chloride-vinyl acetate-maleic anhydride copolymers and the like.

Suitable crosslinking agents which can crosslink these resins upon application of heat include isocyanate compounds, amino resins, phenol resins, amines, epoxy compounds and the like. For example, specific examples of such isocyanate compounds include poly isocyanate compounds having a plurality of isocyanate groups such as hexamethylene diisocyanate (HDI), tolylene diisocyanate (TDI), xylylene diisocyanate (XDI), and adducts of these isocyanate compounds with trimethylol propane and the like, buret type compounds of these isocyanate compounds, isocyanurate type compounds of these isocyanate compounds and blocked isocyanate compounds of these isocyanate compounds.

As for the addition quantity of the crosslinking agents, the ratio of the number of active groups included in the resin to the number of functional groups included in the crosslinking agent is preferably from about 0.01 to about 1 to maintain good heat resistance and good image formation/erasure properties of the recording material.

In addition, the recording layer and the protective layer may include a crosslinking promoter, which is a catalyst useful for this kind of reaction, for example, tertiary amines such as 1,4-diaza-bicyclo(2,2,2) octane, and metal compounds such as organic tin compounds.

Crosslinking can be effected by application of an electron beam or ultraviolet light. Suitable monomers useful for forming a crosslinked recording layer and protective layer which can be crosslinked upon application of electron beam or ultraviolet light include, but are not limited to:

Monomers Having One Functional Group methyl methacrylate, ethyl methacrylate, n-butyl methacrylate, iso-butyl methacrylate, t-butyl methacrylate, 2-ethylhexyl methacrylate, lauryl methacrylate, tridecyl methacrylate, stearyl methacrylate, cyclohexyl methacrylate, benzyl methacrylate, methacrylic acid, 2-hydroxyethyl methacrylate, 2-hydroxypropyl methacrylate, dimethylaminoethyl methacrylate, methyl chloride salts of dimethylaminoethyl methacrylate, diethylaminoethyl methacrylate, glycidyl methacrylate, tetrahydrofurfuryl methacrylate, allyl methacrylate, 2-ethoxyethyl methacrylate, 2-ethylhexyl acrylate, 2-ethoxyethyl acrylate, 2-ethoxyethoxyethyl acrylate, 2-hydroxyethyl acrylate, 2-hydroxypropyl acrylate, dicyclopentenylethyl acrylate, N-vinyl pyrrolidone and vinyl acetate.

Monomers Having Two Functional Groups ethylene glycol dimethacrylate, triethylene glycol dimethacrylate, tetraethylene glycol dimethacrylate, 1,3-butylene glycol dimethacrylate, 1,6-hexanediol dimethacrylate, 1,4-butanediol diacrylate, 1,6-hexanediol diacrylate, 1,9-nonanediol diacrylate, neopentyl glycol diacrylate, tetraethylene glycol diacrylate, tripropylene glycol diacrylate, polypropylene glycol diacrylate, diacrylate esters of an adduct of bisphenol A with ethylene oxide, glycerin methacrylate acrylate, diacrylate esters of an adduct of neopentyl glycol with two moles of propylene oxide, diethylene glycol diacrylate, polyethylene glycol (400) diacrylate, diacrylate esters of an ester of hydroxy pivalate and neopentyl glycol, 2,2-bis(4-acryloyloxydiethoxyphenyl) propane, neopentyl glycol diadipate diacrylate, diacrylate esters of an adduct of neopentyl glycol hydroxypivalate with ϵ-caprolactone, 2-(2-hydroxy-1,1-dimethylethyl)-5-hydroxymethyl-5-ethyl-1,3-dioxane diacrylate, tricyclodecane dimethylol diacrylate, adducts of tricyclodecane dimethylol diacrylate with ϵ-caprolactone, and 1,6-hexanediol glycidyl ether diacrylate.

Monomers Having Three or More Functional Groups trimethylol propane trimethacrylate, trimethylol propane triacrylate, acrylate esters of an adduct of glycerin with propylene oxide, trisacryloyloxyethyl phosphate, pentaerythritol acrylate, triacrylate esters of an adduct of trimethylol propane with three moles of propylene oxide, dipentaerythritol polyacrylate, polyacrylate esters of an adduct of dipentaerythritol with ϵ-caprolactone, dipentaerythritol propionate triacrylate, triacrylate esters of hydroxypivalic aldehyde modified dimethylol propane, dipentaerythritol propionate tetraacrylate, ditrimethylol propane tetraacrylate, dipentaerythritol propionate pentaacrylate, dipentaerythritol hexaacrylate and adducts of dipentaerythritol hexaacrylate with ϵ-caprolactone.

Oligomers adducts of bisphenol A with diepoxy acrylic acid.

When a resin is crosslinked using ultraviolet light, one or more of the following photopolymerization initiators and photopolymerization promoters can be used in the recording layer and the protective layer.

Specific examples of such photopolymerization initiators include:

benzoin ethers such as isobutyl benzoin ether, isopropyl benzoin ether, benzoin ethyl ether and benzoin methyl ether; α-acyloxime esters such as 1-phenyl-1,2-propanedione-2-(o-ethoxycarbonyl)oxime; benzyl ketals such as 2,2-dimethoxy-2-phenyl acetophenone and benzyl hydroxycyclohexylphenyl ketone; acetophenone derivatives such as diethoxy acetophenone and 2-hydroxy-2-methyl-1-phenylpropane-1-one; and ketones such as benzophenone, 1-chlorothioxanthone, 2-chlorothioxanthone, isopropylthioxanthone, 2-methylthioxanthone and 2-chlorobenzophenone. These photopolymerization initiators are employed alone or in combination.

The content of the photopolymerization initiator in the recording layer or the protective layer is preferably from about 0.005 to about 1.0 part by weight, and more preferably from about 0.01 to about 0.5 part by weight, per 1 part by weight of the monomer or the oligomer.

Suitable photopolymerization promoters include aromatic tertiary amines and aliphatic amines. Specific examples of such photopolymerization promoters which are employed alone or in combination include p-dimethylamino benzoic acid isoamyl ester, p-dimethylamino benzoic acid ethyl ester and the like. The content of the photopolymerization promoter in the. recording layer or the protective layer is preferably from about 0.1 to about 5 parts by weight, and more preferably from about 0.3 to about 3 parts by weight, per 1 part by weight of the photopolymerization initiator.

Suitable light sources useful for irradiating ultraviolet light include mercury-vapor lamps, metal-halide lamps, gallium lamps, mercury-xenon lamps, flashing lamps and the like. The light source should be selected so that the spectrum of the ultraviolet light irradiated from the light source corresponds to the absorption spectrum of the photopolymerization initiator and the photopolymerization promoter included in the protective layer. Irradiation conditions of ultraviolet light such as output of lamp power, irradiation width and feeding speed (i.e., irradiation time) should be determined so that the resin in the recording layer or the protective layer can be securely crosslinked.

Electron beam irradiation apparatus includes scanning type and non-scanning type electron beam irradiation apparatus. A suitable apparatus is selected depending on the irradiation area and the irradiation dose required for crosslinking the recording layer or the protective layer. Irradiation conditions such as electron beam current, irradiation width and irradiation speed should be determined depending on the irradiation dose required for crosslinking the resin included in the recording layer or the protective layer.

The recording layer of the recording material of the present invention preferably includes phenolic compounds having the following formula (13) as a color developer to obtain good image qualities:

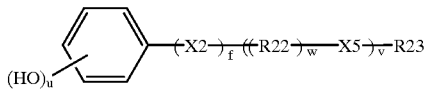

(13)

wherein X2 represents a divalent group including a hetero atom and f is 0 or 1; X3 represents a divalent group having a hetero atom; R22 represents a divalent hydrocarbon group; R23 represents a hydrocarbon group having from 1 to 22 carbon atoms; v is 0 or an integer of from 1 to 4, and when v is 2 to 4, each of repeated R22 may be the same or different from each other and each of repeated X3 may be the same or different from each other; u is an integer of from 1 to 3; and w is 0 or 1.

In formula (13), R22 and R23 are independently a hydrocarbon group which is optionally substituted with a group such as a hydroxy group, a halogen atom or an alkoxy group and which may be an aliphatic hydrocarbon group, an aromatic hydrocarbon group or a hydrocarbon group including both an aliphatic hydrocarbon group and an aromatic hydrocarbon group. The aliphatic hydrocarbon group may be linear or branched, and may include an unsaturated bond. The total carbon number of R22 and R23 is preferably not less than 8, and more preferably not less than 11, to maintain good color formation stability and good erasure properties of the recording material.

Suitable groups for use as R22 include groups shown in Table 17 other than a direct bonding (i.e., w is 0).

TABLE 17

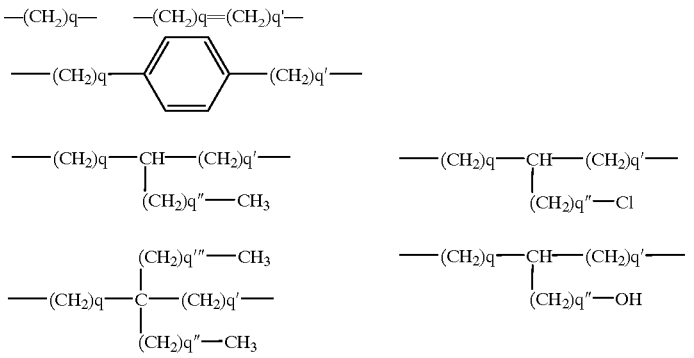

wherein q, q', q" and q'" are independently an integer, and are determined so that the carbon number of R22 satisfies the requirement mentioned above.

Suitable groups for use as R23 include groups as shown in Table 18.

TABLE 18

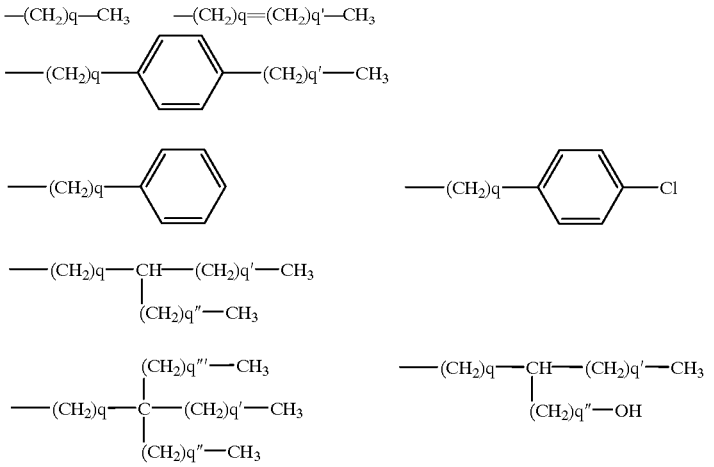

wherein q, q', q" and q'" are independently an integer, and are determined so that the carbon number of R23 satisfies the requirement mentioned above.

Suitable groups for use as X2 and X3 include divalent groups including at least one of groups as shown in Table 19.

TABLE 19

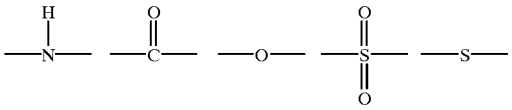

Specific examples of such divalent groups include groups as shown in Table 20.

TABLE 20

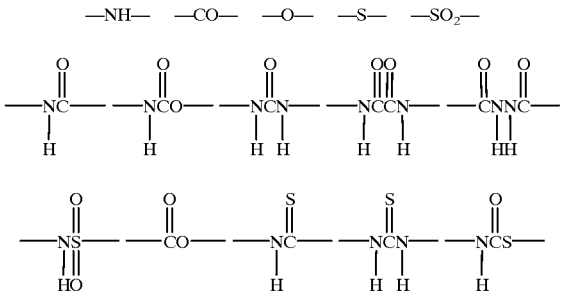

Suitable phenolic compounds for use as a color developer in the recording layer include compounds having the following formula (14), (15), (16), (17), (18), (19), (20) and (21).

(14)

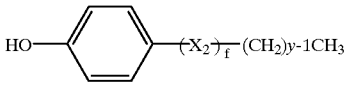

-continued (15)

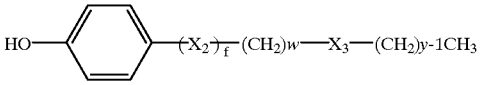

(16)

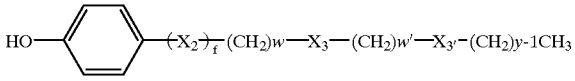

(17)

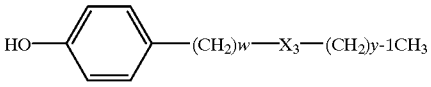

(18)

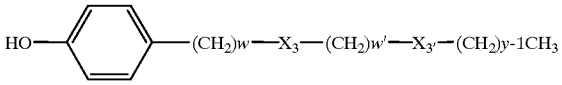

(19)

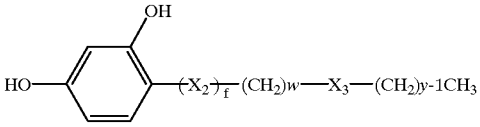

(20)

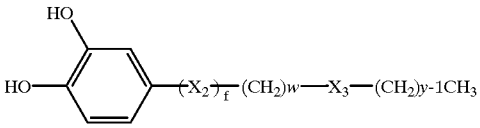

(21)

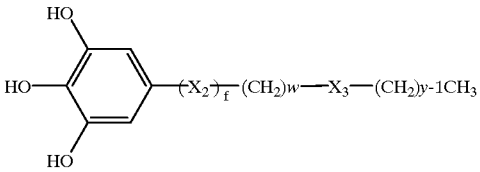

wherein f is 0 or 1; and w, w' and y are independently an integer, and are determined so that the number of the carbon atoms of the resultant group R22 and R23 falls into the range defined above and the total carbon atoms thereof preferably falls into the desired range mentioned above.

More specifically, specific examples of the compounds having formula (15) include compounds as shown in Table 21, but are not limited thereto.
TABLE 21
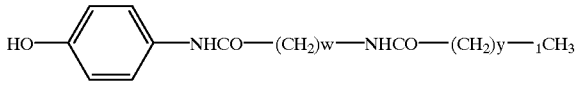
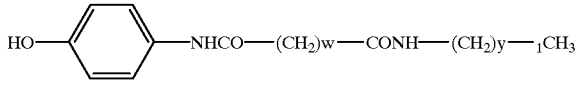
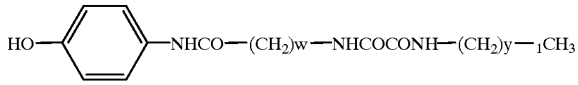
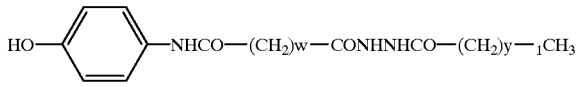
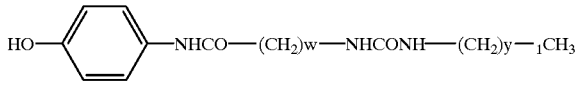
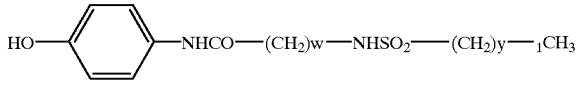
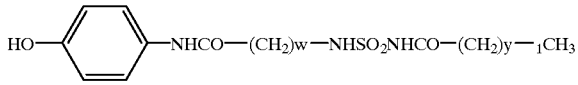
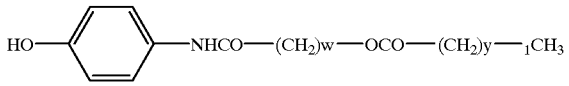
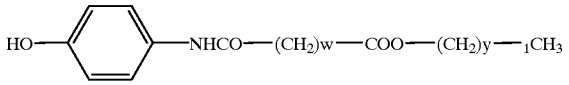
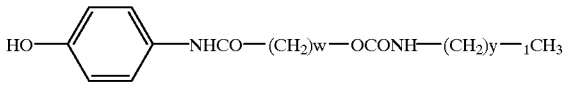
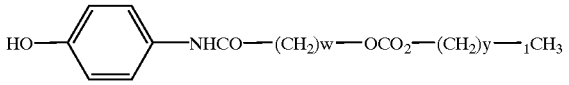
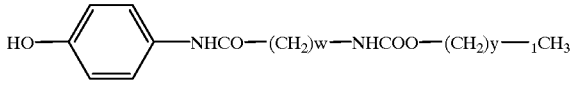
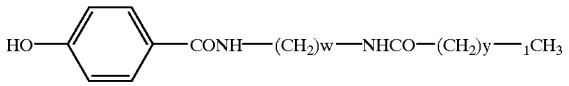
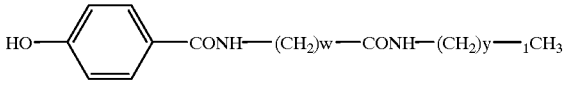
TABLE 21-continued
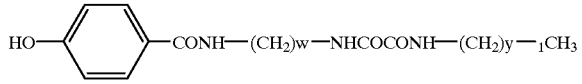
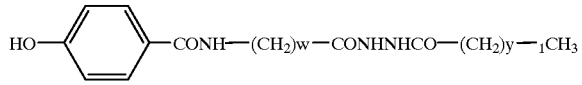
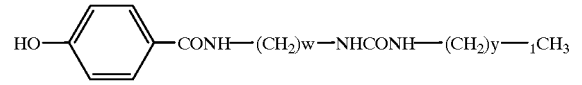
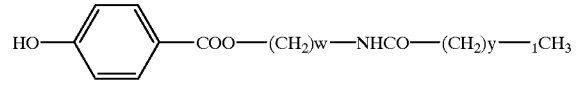
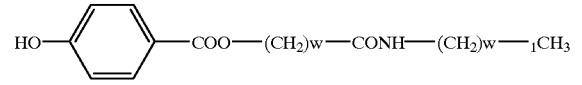
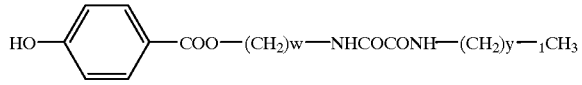
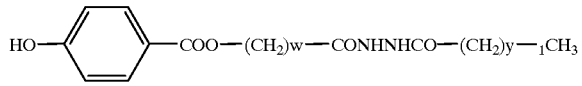
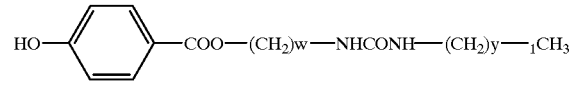
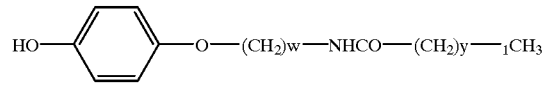
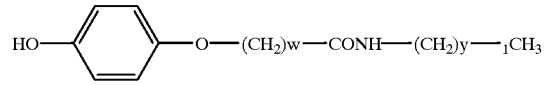
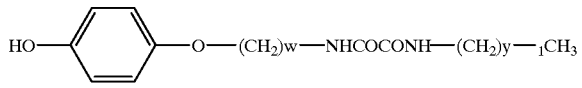
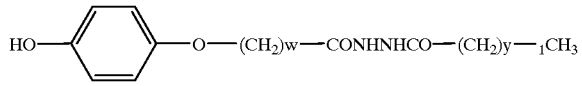
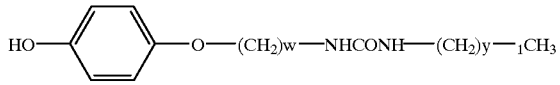
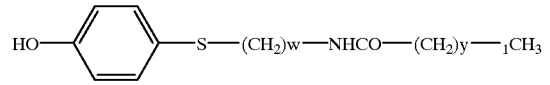

TABLE 21-continued

| |
|---|
| HO—C6H4—S—(CH2)w—CONH—(CH2)y—1CH3 |
| HO—C6H4—S—(CH2)w—NHCOCONH—(CH2)y—1CH3 |
| HO—C6H4—S—(CH2)w—NHCOCONH—(CH2)y—1CH3 |
| HO—C6H4—S—(CH2)w—NHCONH—(CH2)y—1CH3 |
| HO—C6H4—CO—(CH2)w—NHCO—(CH2)y—1CH3 |
| HO—C6H4—CO—(CH2)w—CONH—(CH2)y—1CH3 |
| HO—C6H4—CO—(CH2)w—NHCOCONH—(CH2)y—1CH3 |
| HO—C6H4—CO—(CH2)w—CONHNHCO—(CH2)y—1CH3 |
| HO—C6H4—CO—(CH2)w—NHCONH—(CH2)y—1CH3 |
| HO—C6H4—NHCONH—(CH2)w—NHCO—(CH2)y—1CH3 |
| HO—C6H4—NHCONH—(CH2)w—CONH—(CH2)y—1CH3 |
| HO—C6H4—NHCONH—(CH2)w—NHCOCONH—(CH2)y—1CH3 |
| HO—C6H4—NHCONH—(CH2)w—CONHNHCO—(CH2)y—1CH3 |
| HO—C6H4—NHCONH—(CH2)w—NHCONH—(CH2)y—1CH3 |

Similarly, specific examples of the phenolic compounds having a formula (14), (16), (17), (18), (19), (20) or (21) include compounds similar to those shown in Table 21, but are not limited thereto.

Even more specifically, specific examples of the phenolic compounds having the following formula (22) shown in Table 21 include compounds shown in Table 22, but the phenolic compounds are not limited thereto.

(22)

HO—C6H4—NHCO—(CH2)r—NHCO—(CH2)s-1CH3

| |
|---|
| HO—C6H4—NHCO—(CH2)2—NHCO—(CH2)10CH3 |
| HO—C6H4—NHCO—(CH2)2—NHCO—(CH2)10CH3 |
| HO—C6H4—NHCO—(CH2)2—NHCO—(CH2)12CH3 |
| HO—C6H4—NHCO—(CH2)2—NHCO—(CH2)14CH3 |
| HO—C6H4—NHCO—(CH2)2—NHCO—(CH2)16CH3 |
| HO—C6H4—NHCO—(CH2)2—NHCO—(CH2)20CH3 |
| HO—C6H4—NHCO—(CH2)3—NHCO—(CH2)16CH3 |
| HO—C6H4—NHCO—(CH2)5—NHCO—(CH2)16CH3 |
| HO—C6H4—NHCO—(CH2)7—NHCO—(CH2)16CH3 |
| HO—C6H4—NHCO—(CH2)11—NHCO—(CH2)16CH3 |
| HO—C6H4—NHCO—(CH2)12—NHCO—(CH2)16CH3 |

-continued

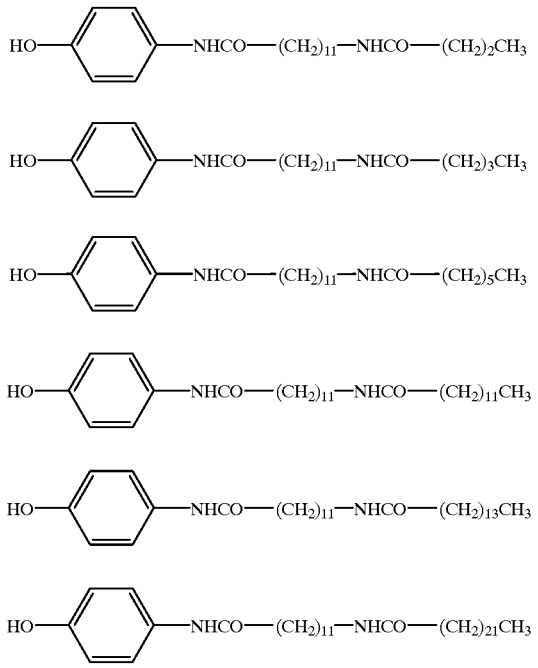

In addition, specific examples of the other compounds shown in Table 21 include compounds similar to the compounds as shown in Table 22.

Suitable compounds for use as a color developer in combination with the phenolic compounds mentioned above include compounds which have both a structure capable of developing a coloring agent and a structure capable of controlling cohesive force and which are disclosed in Japanese Laid-Open Patent Publication No. 5-124360 in which organic phosphate compounds, carboxylic acid compounds and phenolic compounds each of which has a long chain hydrocarbon group are exemplified as a typical coloring developer. Specific examples of such compounds include:

Organic Phosphate Compounds dodecyl phosphonate, tetradecyl phosphonate, hexadecyl phosphonate, octadecyl phosphonate, eicosyl phosphonate, docosyl phosphonate, tetracosyl phosphonate, ditetradecyl phosphate, dihexadecyl phosphate, dioctadecyl phosphate, dieicosyl phosphate and dibehenyl phosphate;

Aliphatic Carboxylic Acid Compounds 2-hydroxy tetradecanoic acid, 2-hydroxy hexadecanoic-acid, 2-hydroxy octadecanoic acid, 2-hydroxy eicosanoic acid, 2-hydroxy docosanoic acid, 2-bromo hexadecanoic acid, 2-bromo octadecanoic acid, 2-bromo eicosanoic acid, 2-bromo docosanoic acid, 3-bromo octadecanoic acid, 3-bromo docosanoic acid, 2,3-dibromo octadecanoic acid, 2-fluoro dodecanoic acid, 2-fluoro tetradecanoic acid, 2-fluoro hexadecanoic acid, 2-fluoro octadecanoic acid, 2-fluoro eicosanoic acid, 2-fluoro docosanoic acid,-2-iodo hexadecanoic acid, 2-iodo octadecanoic acid, 3-iodo hexadecanoic acid, 3-iodo octadecanoic acid and perfluoro octadecanoic acid; and Aliphatic Dicarboxylic Acid Compounds and Aliphatic tricarboxylic acid compounds 2-dodecyloxy succinate, 2-tetradecyloxy succinate, 2-hexadecyloxy succinate, 2-octadecyloxy succinate, 2-eicosyloxy succinate, 2-docosyloxy succinate, 2-dodecylthio succinate, 2-tetradecylthio succinate, 2-hexadecylthio succinate, 2-octadecylthio succinate, 2-eicosylthio succinate, 2-docosylthic succinate, 2-tetracosylthio succinate, 2-hexadecyldithio succinate, 2-octadecyldithio succinate, 2-eicosyldithio succinate, dodecyl succinate, tetradecyl succinate, pentadecyl succinate, hexadecyl succinate, octadecyl succinate, eicosyl succinate, docosyl succinate, 2,3-dihexadecyl succinate, 2,3-dioctadecyl succinate, 2-methyl-3-hexadecyl succinate, 2-methyl-3-octadecyl succinate, 2-octadecyl-3-hexadecyl succinate, hexadecyl malonate, octadecyl malonate, eicosyl malonate, docosyl malonate, dihexadecyl malonate, dioctadecyl malonate, didocosyl malonate, methyloctadecyl malonate, 2-hexadecyl glutarate, 2-octadecyl glutarate, 2-eicosyl glutarate, docosyl glutarate, 2-pentadecyl adipate, 2-octadecyl adipate, 2-eicosyl adipate, 2-docosyl adipate, 2-hexadecanoyloxy propane-1,2,3-tricarboxylic acid and 2-octadecanoyloxy propane-1,2,3-tricarboxylic acid.

Hereinafter the electron donating coloring agent in the recording layer will be explained.

Known leuco dyes can be used as the electron donating coloring agent.

Specific examples of leuco dyes for use as a coloring agent in the recording layer of the recording material of the present invention include, but are not limited to:

2-anilino-3-methyl-6-diethylaminofluoran, 2-anilino-3-methyl-6-(di-n-butylamino)fluoran, 2-anilino-3-methyl-6-(N-n-propyl-N-methylamino) fluoran, 2-anilino-3-methyl-6-(N-isopropyl-N-methylamino) fluoran, 2-anilino-3-methyl-6-(N-isobutyl-N-methylamino) fluoran, 2-anilino-3-methyl-6-(N-n-amyl-N-methylamino) fluoran, 2-anilino-3-methyl-6-(N-sec-butyl-N-methylamino) fluoran, 2-anilino-3-methyl-6-(N-n-amyl-N-ethylamino)fluoran, 2-anilino-3-methyl-6-(N-n-isoamyl-N-ethylamino) fluoran, 2-anilino-3-methyl-6-(N-n-propyl-N-isopropylamino)-fluoran, 2-anilino-3-methyl-6-(N-cyclohexyl-N-methylamino)-fluoran, 2-anilino-3-methyl-6-(N-ethyl-p-toluidino)fluoran, 2-anilino-3-methyl-6-(N-methyl-p-toluidino)fluoran, 2-(m-trichloromethylanilino)-3-methyl-6-diethylaminofluoran, 2-(m-trifluoromethylanilino)-3-methyl-6-diethylaminofluoran, 2-(m-trichloromethylanilino)-3-methyl-6-(N-cyclohexyl-N-methylamino)fluoran, 2-(2,4-dimethylanilino)-3-methyl-6-diethylaminofluoran, 2-(N-ethyl-p-toluidino)-3-methyl-6-(N-ethylanilino) fluoran, 2-(N-ethyl-p-toluidino)-3-methyl-6-(N-propyl-p-toluidino)fluoran, 2-anilino-6-(N-n-hexyl-N-ethylamino)fluoran, 2-(o-chloroanilino)-6-diethylaminofluoran, 2-(o-chloroanilino)-6-dibutylaminofluoran, 2-(m-trifluoromethylanilino)-6-diethylaminofluoran, 2,3-dimethyl-6-dimethylaminofluoran, 3-methyl-6-(N-ethyl-p-toluidino)fluoran, 2-chloro-6-diethylaminofluoran,
2-bromo-6-diethylaminofluoran,
2-chloro-6-dipropylaminofluoran,
3-chloro-6-cyclohexylaminofluoran,
3-bromo-6-cyclohexylaminofluoran,
2-chloro-6-(N-ethyl-N-isoamylamino)fluoran,
2-chloro-3-methyl-6-diethylaminofluoran,
2-anilino-3-chloro-6-diethylaminofluoran,
2-(o-chloroanilino)-3-chloro-6-cyclohexylaminofluoran,
2-(m-trifluoromethylanilino)-3-chloro-6-diethylaminofluoran,
2-(2,3-dichloroanilino)-3-chloro-6-diethylaminofluoran,
1,2-benzo-6-diethylaminofluoran,
3-diethylamino-6-(m-trifluoromethylanilino)fluoran,
3-(1-ethyl-2-methylindole-3-yl)-3-(2-ethoxy-4-diethylaminophenyl)-4-azaphthalide,
3-(1-octyl-2-methylindole-3-yl)-3-(2-ethoxy-4-diethylaminophenyl)-4-azaphthalide,
3-(1-ethyl-2-methylindole-3-yl)-3-(2-ethoxy-4-diethylaminophenyl)-7-azaphthalide,
3-(1-ethyl-2-methylindole-3-yl)-3-(2-methyl-4-diethylaminophenyl)-4-azaphthalide,
3-(1-ethyl-2-methylindole-3-yl)-3-(2-methyl-4-diethylaminophenyl)-7-azaphthalide,
3-(1-ethyl-2-methylindole-3-yl)-3-(4-diethylaminophenyl)-4-azaphthalide,
3-(1-ethyl-2-methylindole-3-yl)-3-(4-N-n-amyl-N-methylaminophenyl)-4-azaphthalide,
3-(1-methyl-2-methylindole-3-yl)-3-(2-hexyloxy-4-diethylaminophenyl)-4-azaphthalide,
3,3-bis(2-ethoxy-4-diethylaminophenyl)-4-azaphthalide, and
3,3-bis(2-ethoxy-4-diethylaminophenyl)-7-azaphthalide.

The coloring agent for use in the recording layer of the present invention may include conventional leuco dyes. Specific examples of such conventional leuco dyes, which are employed alone or in combination, include:

2-(p-acetylanilino)-6-(N-n-amyl-N-n-butylamino)fluoran,
2-benzylamino-6-(N-ethyl-p-toluidino)fluoran,
2-benzylamino-6-(N-methyl-2,4-dimethylanilino)fluoran,
2-benzylamino-6-(N-ethyl-2,4-dimethylanilino)fluoran,
2-dibenzylamino-6-(N-methyl-p-toluidino)fluoran,
2-dibenzylamino-6-(N-ethyl-p-toluidino)fluoran,
2-(di-p-methylbenzylamino)-6-(N-ethyl-p-toluidino)fluoran,
2-(α-phenylethylamino)-6-(N-ethyl-p-toluidino)fluoran,
2-methylamino-6-(N-methylanilino)fluoran,
2-methylamino-6-(N-ethylanilino)fluoran,
2-methylamino-6-(N-propylanilino)fluoran,
2-ethylamino-6-(N-methyl-p-toluidino)fluoran,
2-methylamino-6-(N-methyl-2,4-dimethylanilino)fluoran,
2-ethylamino-6-(N-ethyl-2,4-dimethylanilino)fluoran,
2-dimethylamino-6-(N-methylanilino)fluoran,
2-dimethylamino-6-(N-ethylanilino)fluoran,
2-diethylamino-6-(N-methyl-p-toluidino)fluoran,
2-diethylamino-6-(N-ethyl-p-toluidino)fluoran,
2-dipropylamino-6-(N-methylanilino)fluoran,
2-dipropylamino-6-(N-ethylanilino)fluoran,
2-amino-6-(N-methylanilino)fluoran,
2-amino-6-(N-ethylanilino)fluoran,
2-amino-6-(N-propylanilino)fluoran,
2-amino-6-(N-methyl-p-toluidino)fluoran,
2-amino-6-(N-ethyl-p-toluidino)fluoran,
2-amino-6-(N-propyl-p-toluidino)fluoran,
2-amino-6-(N-methyl-p-ethylanilino)fluoran,
2-amino-6-(N-ethyl-p-ethylanilino)fluoran,
2-amino-6-(N-propyl-p-ethylanilino)fluoran,
2-amino-6-(N-methyl-2,4-dimethylanilino)fluoran,
2-amino-6-(N-ethyl-2,4-dimethylanilino)fluoran,
2-amino-6-(N-propyl-2,4-dimethylanilino)fluoran,
2-amino-6-(N-methyl-p-chloroanilino)fluoran,
2-amino-6-(N-ethyl-p-chloroanilino)fluoran,
2-amino-6-(N-propyl-p-chloroanilino)fluoran,
1,2-benzo-6-(N-ethyl-N-isoamylamino)fluoran,
1,2-benzo-6-dibutylaminofluoran,
1,2-benzo-6-(N-ethyl-N-cyclohexylamino)fluoran,
1,2-benzo-6-(N-ethyl-p-toluidino)fluoran,
2-anilino-3-methyl-6-(N-2-ethoxypropyl-N-ethylamino)fluoran,
2-(p-chloroanilino)-6-(N-n-octylamino)fluoran,
2-(p-chloroanilino)-6-(N-n-palmitylamino)fluoran,
2-(p-chloroanilino)-6-(di-n-octylamino)fluoran,
2-benzoylamino-6-(N-ethyl-p-toluidino)fluoran,
2-(o-methoxybenzoylamino)-6-(N-methyl-p-toluidino)fluoran,
2-dibenzylamino-4-methyl-6-diethylaminofluoran,
2-dibenzylamino-4-methoxy-6-(N-methyl-p-toluidino)fluoran,
2-dibenzylamino-4-methyl-6-(N-ethyl-p-toluidino)fluoran,
2-(α-phenylethylamino)-4-methyl-6-diethylaminofluoran,
2-(p-toluidino)-3-(t-butyl)-6-(N-methyl-p-toluidino)fluoran,
2-(o-methoxycarbonylanilino)-6-diethylaminofluoran,
2-acetylamino-6-(N-methyl-p-toluidino)fluoran,
4-methoxy-6-(N-ethyl-p-toluidino)fluoran,
2-ethoxyethylamino-3-chloro-6-dibutylaminofluoran,
2-dibenzylamino-4-chloro-6-(N-ethyl-p-toluidino)fluoran,
2-(α-phenylethylamino)-4-chloro-6-diethylaminofluoran,
2-(N-benzyl-p-trifluoromethylanilino)-4-chloro-6-diethylaminofluoran,
2-anilino-3-methyl-6-pyrrolidinofluoran,
2-anilino-3-chloro-6-pyrrolidinofluoran,
2-anilino-3-methyl-6-(N-ethyl-N-tetrahydrofurfurylamino)fluoran,
2-mesidino-4',5'-benzo-6-diethylaminofluoran,
2-(m-trifluoromethylanilino)-3-methyl-6-pyrrolidinofluoran,
2-(α-naphthylamino)-3,4-benzo-4'-bromo-6-(N-benzyl-N-cyclohexylamino)fluoran,
2-piperidino-6-diethylaminofluoran,
2-(N-n-propyl-p-trifluoromethylanilino)-6-morpholinofluoran, 2-(di-N-p-chlorophenyl-methylamino)-6-pyrrolidinofluoran, 2-(N-n-propyl-m-trifluoromethylanilino)-6-morpholinofluoran, 1,2-benzo-6-(N-ethyl-N-n-octylamino)fluoran, 1,2-benzo-6-diallylaminofluoran, 1,2-benzo-6-(N-ethoxyethyl-N-ethylamino)fluoran, benzoleucomethyleneblue, 2-[3,6-bis(diethylamino)]-6-(o-chloroanilino)xanthyl benzoic acid lactam, 2-[3,6-bis(diethylamino)]-9-(o-chloroanilino)xanthyl benzoic acid lactam, 3,3-bis(p-dimethylaminophenyl)phthalide, 3,3-bis(p-dimethylaminophenyl)-6-dimethylaminophthalide (i.e., crystal violet lactone)

3,3-bis(p-dimethylaminophenyl)-6-diethylaminophthalide, 3,3-bis(p-dimethylaminophenyl)-6-chlorophthalide, 3,3-bis(p-dibutylaminophenyl)phthalide, 3-(2-methoxy-4-dimethylaminophenyl)-3-(2-hydroxy-4,5-dichlorophenyl)phthalide, 3-(2-hydroxy-4-dimethylaminophenyl)-3-(2-methoxy-5-chlorophenyl)phthalide, 3-(2-hydroxy-4-dimethoxyaminophenyl)-3-(2-methoxy-5-chlorophenyl)phthalide, 3-(2-hydroxy-4-dimethylaminophenyl)-3-(2-methoxy-5-nitrophenyl)phthalide, 3-(2-hydroxy-4-diethylaminophenyl)-3-(2-methoxy-5-methylphenyl)phthalide, 3-(2-methoxy-4-dimethylaminophenyl)-3-(2-hydroxy-4-chloro-5-methoxyphenyl)phthalide, 3,6-bis(dimethylamino)fluorenespiro(9,3')-6'-dimethylaminophthalide, 6'-chloro-8'-methoxy-benzoindolino-spiropyran, and 6'-bromo-2'-methoxy-benzoindolino-spiropyran.

The coloring agent and color developer may be used while being microencapsulated.

The mixing ratio of the coloring agent to the color developer in the recording layer, which depends on the materials of the coloring agent and the color developer used, is from about 1:0.1 to 1:20 by mole, and preferably from about 1:0.2 to 1:10 by mole, to maintain good image density of the recorded image.

The content of the erasure promoter and the color formation/erasure controlling agent is preferably from 0.1 to 300 parts by weight, and more preferably from 3 to 100 parts by weight, per 100 parts by weight of the color developer included in the recording layer.

The ratio of the coloring components to the binder resin is preferably from 1:0.1 to 1:10 by weight to maintain good mechanical strength of the recording layer and image density of the recorded image.

The recording layer can be formed by coating a coating liquid in which the coloring agent, color developer, erasure promoter, color formation/erasure controlling agent, binder resin and a solvent are uniformly mixed, and drying the coated liquid.

Specific examples of the solvents include water, alcohols such as methanol, isopropanol, n-butanol and methylisocarbinol; ketones such as acetone, 2-butanone, ethyl amyl ketone, diacetone alcohol, isophorone and cyclohexanone; amides such as N,N-dimethylformamide and N,N-dimethylacetamide; ethers such as diethyl ether, isopropyl ether, tetrahydrofuran, 1,4-dioxane and 3,4-dihydro-2H-pyran; glycol ethers such as 2-methoxyethanol, 2-ethoxyethanol, 2-butoxyethanol and ethylene glycol dimethyl ether; glycol ether acetates such as 2-methoxyethyl acetate, 2-ethoxyethyl acetate and 2-butoxyethyl acetate; esters such as methyl acetate, ethyl acetate, isobutyl acetate, amyl acetate, ethyl lactate and ethylene carbonate; aromatic hydrocarbons such as benzene, toluene and xylene; aliphatic hydrocarbons such as hexane, heptane, iso-octane and cyclohexane; halogenated hydrocarbons such as methylene chloride, 1,2-dichloroethane, dichloropropane and chlorobenzene; sulfoxides such as dimethylsulfoxide; and pyrrolidones such as N-methyl-2-pyrrolidone and N-octyl-2-pyrrolidone.

The coating liquid can be prepared using a dispersing apparatus such as paint shakers, ball mills, attritors, three-roll mills, sand mills, Dyno mills and colloid mills. All of the materials to be included in a coating liquid are mixed and dispersed in a solvent to prepare the coating liquid. Alternatively, each of the materials may be dispersed in a solvent and then the prepared dispersions are mixed to prepare a coating liquid. In addition, the coating liquid may be heated and then cooled to deposit one or more components in the coating liquid.

The recording layer can be formed by any known coating method such as blade coating, spray coating, air knife coating, bead coating, curtain coating, gravure coating, kiss coating, reverse roll coating, dip coating and die coating.

The recording layer is crosslinked, if desired, after the coating and drying operations. When crosslinking is performed by heat, the heating may be performed at a high temperature for a relatively short time, or at a relatively low temperature for a long time.

When ultraviolet or electron beam crosslinking is performed, known crosslinking apparatus can be used.

Suitable light sources useful for irradiating ultraviolet light include mercury-vapor lamps, metal-halide lamps, gallium lamps, mercury-xenon lamps, flashing lamps and the like. The light source should be selected so that the spectrum of the ultraviolet light irradiated from the light source corresponds to the absorption spectrum of the photopolymerization initiator and the photopolymerization promoter included in the protective layer. Irradiation conditions of ultraviolet light such as output of lamp power, irradiation width and feeding speed (i.e., irradiation time) should be determined so that the resin in the recording layer or the protective layer can be securely crosslinked.

Electron beam irradiation apparatus includes scanning type and non-scanning type electron beam irradiation apparatus which is selected depending on the irradiation area and the irradiation dose required for crosslinking the recording layer or the protective layer. Irradiation conditions such as electron beam current, irradiation width and irradiation speed should be determined depending on the irradiation dose required for crosslinking the resin included in the recording layer or the protective layer.

The thickness of the recording layer is preferably from 1 to 20 $\mu$m, and more preferably from 3 to 10 $\mu$m.

The recording layer may include an auxiliary agent to improve the coating properties and color formation/erasure properties. For example, surfactants, electroconductive agents, fillers, antioxidants, photo stabilizers, and color stabilizers can be used as an auxiliary agent.

In the recording material of the present invention, a protective layer can be formed overlying the recording layer. The protective layer includes a crosslinked resin. Suitable crosslinkable resins for use in the protective layer include the resins mentioned above for use in the recording layer. In addition, the protective layer may include a resin other than the crosslinked resin mentioned above. Specific examples of such resins include polyvinyl alcohol, styrene-maleic anhydride copolymers, carboxyl modified polyethylene, melamine-formaldehyde resins, urea-formaldehyde resins and the like.

The thickness of the protective layer is preferably from 0.1 to 20 μm, and more preferably from 0.3 to 10 μm.

An intermediate layer can be formed between the recording layer and the protective layer to improve the adhesion of the recording layer to the protective layer, to prevent deterioration of the recording layer, which is caused by contacting with the protective layer coating liquid on the recording layer, and to prevent the migration of the additives included in the protective layer into the recording layer.

The recording material may include an undercoat layer between the substrate and the recording layer to effectively utilize heat applied for recording images, to obtain good adhesion between the recording layer and the substrate and/or to prevent the substrate from deteriorating caused by contacting with the recording layer coating liquid. The heat insulating undercoat layer can be formed by coating liquid in which organic or inorganic hollow particles are dispersed in a binder resin solution.

The resins mentioned above for use in the recording layer can also be used for the intermediate layer and the undercoat layer.

Various fillers can be used in the undercoat layer, recording layer, intermediate layer and protective layer. Suitable fillers include inorganic fillers and organic fillers. Specific examples of the inorganic filers include carbonate such as calcium carbonate and magnesium carbonate; silicates such as silicic acid anhydride, hydrated silicic acid, hydrated aluminum silicate and hydrated calcium silicate; metal hydroxides such as aluminum hydroxide and iron hydroxide; metal oxides such as zinc oxide, indium oxide, alumina, silica, zirconium oxide, tin oxide, cerium oxide, iron oxide, antimony oxide, barium oxide, calcium oxide, bismuth oxide, nickel oxide, magnesium oxide, chromium oxide, manganese oxide, tantalum oxide, niobium oxide, thorium oxide, hafnium oxide, molybdenum oxide, iron ferrite, nickel ferrite, cobalt ferrite, barium titanate and potassium titanate; metal sulfides and metal sulfates such as zinc sulfide and barium sulfate; metal carbides such as titanium carbide, silicon carbide, molybdenum carbide, tungsten carbide and tantalum carbide; and metal nitrides such as aluminum nitride, silicon nitride, boron nitride, zirconium nitride, vanadium nitride, titanium nitride, niobium nitride and gallium nitride. Specific examples of the organic fillers include silicone resins, cellulose resins, epoxy resins, nylon resins, phenolic resins, polyurethane resins, urea resins, melamine resins, polyester resins, polycarbonate resins, styrene resins such as polystyrene resins, styrene-isoprene copolymers and styrene-vinyl benzene copolymers; acrylic resins such as vinylidene chloride-acryl copolymers, acrylurethane copolymers and ethylene-acryl copolymers; polyethylene resins, formaldehyde resins such as benzoguanamine-formaldehyde resins and melamine-formaldehyde resins; and polymethyl methacrylate resins and vinyl chloride resins.

These fillers can be used alone or in combination. In addition, the fillers may be complex particles. The fillers may have any shape such as spherical, granular, plate and needle shapes.

The content of the filler in each layer is preferably from 1 to 95% by volume, and more preferably from 5 to 75% by volume.

A lubricant may be added into these layers. Specific examples of the lubricant include synthesized waxes such as ester waxes, paraffin waxes and polyethylene waxes; vegetable waxes such as hardened caster oil; animal waxes such as hardened beef tallow; higher alcohols such as stearyl alcohol and behenyl alcohol; higher fatty acids such as margaric acid, lauric acid, myristic acid, palmitic acid, stearic acid, and behenic acid; esters of higher fatty acids such as sorbitan fatty acid esters; and amides such as stearic acid amide, oleic acid amide, lauric acid amide, ethylenebisstearic acid amide, methylenebisstearic acid amide and methylolstearic acid amide.

The content of the lubricant in each layer is preferably from 0.1 to 95% by volume, and more preferably from 1 to 75% by volume.

The intermediate layer and protective layer may include an organic ultraviolet absorbing agent in an amount of from 0.5 to 10 parts by weight per 100 parts by weight of the binder resin included in each layer.

Specific examples of the organic ultraviolet absorbing agent include:

benzotriazole type ultraviolet absorbing agents
- 2-(2'-hydroxy-5'-methylphenyl)benzotriazole,
- 2-(2-hydroxy-5-t-butylphenyl)benzotriazole,
- 2-(2'-hydroxy-3',5'-di-t-butylphenyl)benzotriazole,
- 2-(2'-hydroxy-3'-t-butyl-5'-methylphenyl) benzotriazole,
- 2-(2'-hydroxy-5'-octoxyphenyl)benzotriazole,
- 2-(2'-hydroxy-3',5'-di-t-butylphenyl)-5-chlorobenzotriazole, and
- 2-(2'-hydroxy-3'-t-butyl-5'-methylphenyl)-5-chlorobenzotriazole
- 2-(2'-hydroxy-5'-ethoxyphenyl)benzotriazole.

benzophenone type ultraviolet absorbing agents
- 2,4-dihydroxybenzophenone,
- 2-hydroxy-4-methoxybenzophenone,
- 2-hydroxy-4-n-octoxybenzophenone,
- 2-hydroxy-4-dodecyloxybenzophenone,
- 2,2'-dihydroxy-4-methoxybenzophenone,
- 2,2'-dihydroxy-4,4'-dimethoxybenzophenone,
- 2,2',4,4'-tetrahydroxybenzophenone,
- 2-hydroxy-4-methoxy-2'-carboxybenzophenone,
- 2-hydroxy-4-oxybenzylbenzophenone,
- 2-hydroxy-4-chlorobenzophenone,
- 2-hydroxy-4-methoxybenzophenone-5-sulfonic acid,
- 2-hydroxy-4-methoxybenzophenone-5-sulfonic acid sodium salt, and
- 2,2-dihydroxy-4,4'-dimethoxybenzophenone-5-sulfonic acid sodium salt.

salicylic acid ester type ultraviolet absorbing agents
- phenyl salicylate,
- p-octylphenyl salicylate,
- p-t-butylphenyl salicylate,
- carboxyphenyl salicylate,
- methylphenyl salicylate,
- dodecylphenyl salicylate,
- 2-ethylhexylphenyl salicylate, and
- homomenthylphenyl salicylate.

cyanoacrylate type ultraviolet absorbing agents
- 2-ethylhexyl-2-cyano-3,3'-diphenyl acrylate, and
- ethyl-2-cyano-3,3'-diphenyl acrylate.

p-aminobenzoic acid type ultraviolet absorbing agents
- p-aminobenzoic acid,
- glyceryl p-aminobenzoate,
- amyl p-dimethylaminobenzoate, and
- ethyl p-dihydroxypropylbenzoate.

cinnamic acid type ultraviolet absorbing agents
2-ethylhexyl p-methoxycinnamate, and
2-ethoxyhexyl p-methoxycinnamate.
other ultraviolet absorbing agents
4-t-butyl-4'-methoxy-dibenzoyl methane
urocanic acid, and
ethyl urocanate.

The intermediate layer and protective layer can be formed by the same method as mentioned above in the recording layer.

Suitable materials for use as the substrate of the recording material of the present invention include any known supporters such as paper, resin films, synthetic papers, metal foils, glass plates and the like. The substrate may be non-colored or colored and may be transparent or opaque. The substrate may be a complex substrate in which two or more substrates are combined. Suitable thickness of the substrate is from a few $\mu$m to a few mm.

The recording material of the present invention may be adhered to a supporting material with an adhesive layer. The adhesive layer may be formed on a part of the recording material or the entire recording material. The recording material which is adhered to a supporting material may be laminated with films or the like.

The recording material of the present invention can be processed into any shape such as sheet, card, roll and the like.

The reversible thermosensitive recording material of the present invention may include an irreversible thermosensitive recording layer. The color of the image of the irreversible thermosensitive recording layer may be the same as or different from that of the reversible thermosensitive recording layer. The irreversible thermosensitive recording layer is preferably formed under the reversible thermosensitive recording layer and the coloring temperature of the irreversible thermosensitive recording layer is preferably higher than that of the reversible thermosensitive recording layer.

Images can be recorded in the recording material of the present invention by heating the recording material, for example, with a thermal pen, a thermal printhead, laser or the like, at an image forming temperature for a short time. When the heating is stopped, the applied heat is quickly diffused, namely, the recorded image is quickly cooled; thereby a stable image can be formed in the recording material. The recorded image can be erased by heating the recording layer at a temperature not lower than the image forming temperature T1 with an appropriate heating device and then gradually cooling the recording layer, or by heating the recording layer at a temperature in an image erasing temperature range, i.e., a temperature not lower than the image erasing temperature T2 but lower than the image forming temperature T1. The latter image erasing method is preferable because images can be rapidly erased. In addition, the recorded image can also be erased by heating a wide area of the recording layer or heating the recording layer for a long time and then cooling the recording layer. This is because in each case the recording layer is gradually cooled. Suitable heating devices useful for erasing images include heaters such as ceramic heaters, plane heaters, heat bars, heat rollers or heat stamps; hot air blowing devices; or thermal printheads. Among these devices, ceramic heaters, plane heaters and heat rollers are preferable. When a thermal printhead is used for erasing images, the heat energy applied to the recording layer is preferably controlled so as to be relatively low compared to the heat energy for image recording by controlling the applied voltage and/or pulse width of a pulse applied to the thermal printhead. By using this method, the image recording and erasing operations can be performed with only one thermal printhead, which allows the so-called "overwriting".

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Example 1

(Formation of Recording Layer)

A mixture of the following components was pulverized and dispersed in a ball mill such that the average particle diameter of the solid components in the liquid was from 0.1 to 3 $\mu$m, to prepare a liquid A.

| (Formulation of liquid A) | |
|---|---|
| 2-anilino-3-methyl-6-dibutylaminofluoran (coloring agent) | 2 |
| Color developer having the following formula | 8 |
| 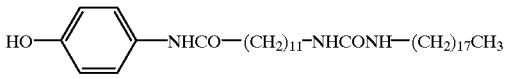 | |
| Color formation/erasure controlling agent having the following formula $CH_3(CH_2)_{17}$—NHCONH—$(CH_2)_2$—COOH | 4 |
| Erasure promoter having the following formula | 4 |
| 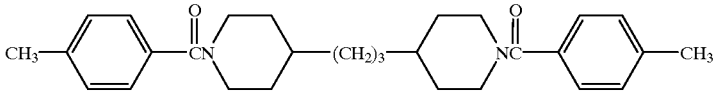 | |
| 15% phenoxy resin solution (phenoxy resin: PKHH manufactured by Union Carbide Corp., solvent: tetrahydrofuran) | 150 |

Twenty (20) parts of adduct type hexamethylene diisocyanate (Coronate HL, manufactured by Nippon Polyurethane Industry Co., Ltd., ethyl acetate solution having a solid content of 75%) were mixed with liquid A and the mixture was stirred to prepare a recording layer coating liquid.

The recording layer coating liquid was coated with a wire bar on a substrate of a polyethylene terephthalate (PET) film having a thickness of 188 μm, dried at 100° C. for 2 minutes, and then heated at 60° C. for 24 hours to form a recording layer of about 8.0 μm in a dry thickness.

Thus, a reversible thermosensitive recording material of the present invention was prepared.

Example 2

(Formation of Recording Layer)

A mixture of the following components was pulverized and dispersed in a ball mill such that the average particle diameter of the solid components in the liquid was from 0.1 to 3 μm, thus a liquid A was prepared:

| (Formulation of liquid A) | |
|---|---|
| 2-anilino-3-methyl-6-N-ethyl-N-p-tolylaminofluoran (coloring agent) | 2 |
| Color developer having the following formula | 8 |
| 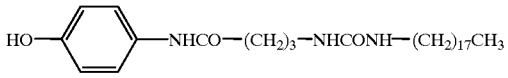 | |
| Color formation/erasure controlling agent having the following formula $CH_3(CH_2)_{17}$—NHCONH—$(CH_2)_5$—COOH | 4 |
| Erasure promoter having the following formula | 4 |
| 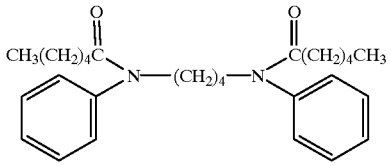 | |
| 15% acryl polyol resin solution (solvent: tetrahydrofuran) | 150 |

Twenty (20) parts of adduct type hexamethylene diisocyanate (Coronate HL, manufactured by Nippon Polyurethane Industry Co., Ltd., ethyl acetate solution having a solid content of 75%) were mixed with liquid A and the mixture was stirred to prepare a recording layer coating liquid.

The recording layer coating liquid was coated with a wire bar on a substrate of a polyethylene terephthalate (PET) film having a thickness of 188 μm, dried at 100° C. for 2 minutes, and then heated at 60° C. for 24 hours to form a recording layer of about 8.0 μm in a dry thickness.

Thus, a reversible thermosensitive recording material of the present invention was prepared.

Example 3

(Formation of Recording Layer)

A mixture of the following components was pulverized and dispersed in a ball mill such that the average particle diameter of the solid components in the liquid was from 0.1 to 3 μm, to prepare a liquid A.

| (Formulation of liquid A) | |
|---|---|
| 3-(4-diethylamino-2-ethoxyphenyl)-3-(1-ethyl-2-methylindol-3-yl)-4-azaphthalide (coloring agent) | 2 |
| Color developer having the following formula | 8 |
| 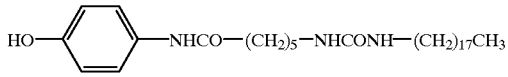 | |
| Color formation/erasure controlling agent having the following formula $CH_3(CH_2)_{17}$—NHCONH—$(CH_2)_{17}$—$CH_3$ | 4 |
| Erasure promoter having the following formula | 4 |
| 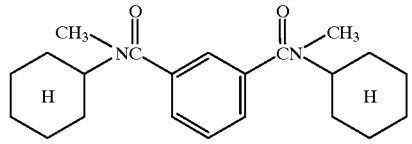 | |
| 15% acryl polyol resin solution (solvent: tetrahydrofuran) | 150 |

Twenty (20) parts of adduct type hexamethylene diisocyanate (Coronate HL, manufactured by Nippon Polyurethane Industry Co., Ltd., ethyl acetate solution having a solid content of 75%) were added to liquid A and the mixture was stirred to prepare a recording layer coating liquid.

The recording layer coating liquid was coated with a wire bar on a substrate of a polyethylene terephthalate (PET) film having a thickness of 188 μm, dried at 100° C. for 2 minutes, and then heated at 60° C. for 24 hours to form a recording layer of about 8.0 μm in a dry thickness.

Thus, a reversible thermosensitive recording material of the present invention was prepared.

Example 4

(Formation of Recording Layer)

A mixture of the following components was pulverized and dispersed in a ball mill such that the average particle diameter of the solid components in the liquid was from 0.1 to 3 μm, to prepare a liquid A.

| (Formulation of liquid A) | |
|---|---|
| 3,3'-bis(2-ethoxy-4-diethylaminophenyl)-4-azaphthalide (coloring agent) | 2 |
| Color developer having the following formula | 8 |
| 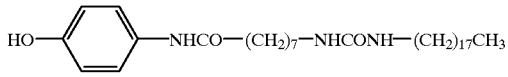 | |
| Color formation/erasure controlling agent having the following formula $CH_3(CH_2)_{17}$—NHCONH—$(CH_2)_{10}$—$CH_3$ | 4 |
| Erasure promoter having the following formula | 4 |

-continued (Formulation of liquid A)

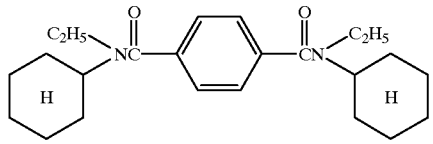

| | |
|---|---|
| 15% phenoxy resin solution (phenoxy resin: PKHH manufactured by Union Carbide Corp., solvent: tetrahydrofuran) | 150 |

Twenty (20) parts of adduct type hexamethylene diisocyanate (Coronate HL, manufactured by Nippon Polyurethane Industry Co., Ltd., ethyl acetate solution having a solid content of 75%) were added to liquid A and the mixture was stirred to prepare a recording layer coating liquid.

The recording layer coating liquid was coated with a wire bar on a substrate of a polyethylene terephthalate (PET) film having a thickness of 188 μm, dried at 100° C. for 2 minutes, and then heated at 60° C. for 24 hours to form a recording layer of about 8.0 μm in a dry thickness.

Thus, a reversible thermosensitive recording material of the present invention was prepared.

Example 5

(Formation of Recording Layer)

A mixture of the following components was pulverized and dispersed in a ball mill such that the average particle diameter of the solid components in the liquid was from 0.1 to 3 μm, to prepare a liquid A.

(Formulation of liquid A)

| | |
|---|---|
| 2-anilino-3-methyl-6-dibutylaminofluoran (coloring agent) | 2 |
| Color developer having the following formula | 8 |

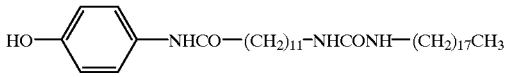

| | |
|---|---|
| Erasure promoter having the following formula | 3 |

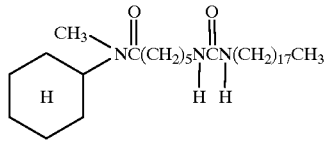

| | |
|---|---|
| 15% acryl polyol resin solution (solvent: tetrahydrofuran) | 70 |

Ten (10) parts of adduct type hexamethylene diisocyanate (Coronate HL, manufactured by Nippon Polyurethane Industry Co., Ltd., ethyl acetate solution having a solid content of 75%) were added to liquid A and the mixture was stirred to prepare a recording layer coating liquid.

The recording layer coating liquid was coated with a wire bar on a substrate of a polyethylene terephthalate (PET) film having a thickness of 188 μm, dried at 100° C. for 2 minutes, and then heated at 60° C. for 24 hours to form a recording layer of about 8.0 μm in a dry thickness.

Thus, a reversible thermosensitive recording material of the present invention was prepared.

Example 6

The procedure for preparation of the recording material in Example 5 was repeated except that the erasure promoter was replaced with an erasure promoter having the following formula:

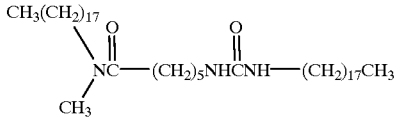

Thus, a reversible thermosensitive recording material of the present invention was prepared.

Example 7

The procedure for preparation of the recording material in Example 5 was repeated except that the color developer and the erasure promoter were replaced with the following color developer and erasure promoter:

Color developer

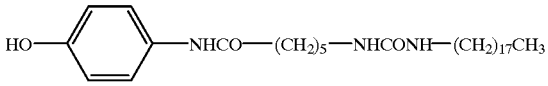

Erasure promoter

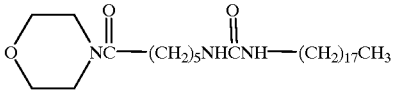

Thus, a reversible thermosensitive recording material of the present invention was prepared.

Example 8

The procedure for preparation of the recording material in Example 7 was repeated except that the erasure promoter was replaced with an erasure promoter having the following formula:

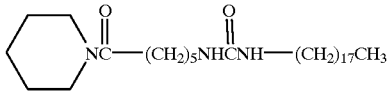

Thus, a reversible thermosensitive recording material of the present invention was prepared.

Example 9

The procedure for preparation of the recording material in Example 7 was repeated except that the erasure promoter was replaced with an erasure promoter having the following formula:

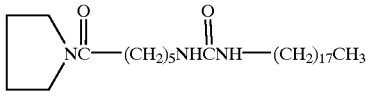

Thus, a reversible thermosensitive recording material of the present invention was prepared.

Example 10

The procedure for preparation of the recording material in Example 1 was repeated except that liquid A was replaced with a liquid A having the following formulation:

| (Formulation of liquid A) | |
|---|---|
| 2-anilino-3-methyl-6-dibutylaminofluoran (coloring agent) | 2 |
| Color developer having the following formula | 8 |
| 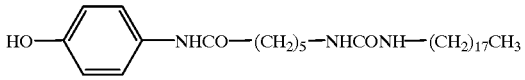 | |
| Erasure promoter having the following formula | 1 |
| 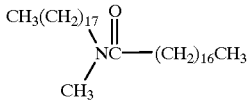 | |
| Color formation/erasure controlling agent having the following formula $CH_3(CH_2)_4$—NHCONH—$(CH_2)_{17}CH_3$ | 3 |
| 15% acryl polyol resin solution (solvent: tetrahydrofuran) | 70 |

Thus, a reversible thermosensitive recording material of the present invention was prepared.

Example 11

The procedure for preparation of the recording material in Example 10 was repeated except that the erasure promoter was replaced with an erasure promoter having the following formula:

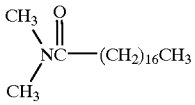

Thus, a reversible thermosensitive recording material of the present invention was prepared.

Example 12

The procedure for preparation of the recording material in Example 10 was repeated except that the erasure promoter was replaced with an erasure promoter having the following formula:

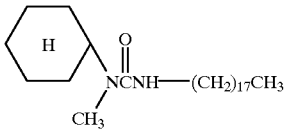

Thus, a reversible thermosensitive recording material of the present invention was prepared.

Example 13

The procedure for preparation of the recording material in Example 10 was repeated except that the erasure promoter was replaced with an erasure promoter having the following formula:

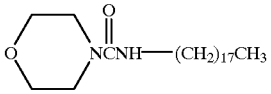

Thus, a reversible thermosensitive recording material of the present invention was prepared.

Example 14

The procedure for preparation of the recording material in Example 10 was repeated except that the erasure promoter was replaced with an erasure promoter having the following formula:

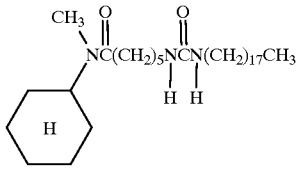

Thus, a reversible thermosensitive recording material of the present invention was prepared.

Example 15

The procedure for preparation of the recording material in Example 10 was repeated except that the erasure promoter was replaced with an erasure promoter having the following formula:

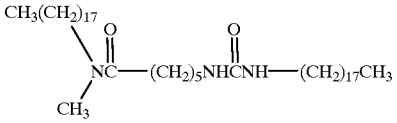

Thus, a reversible thermosensitive recording material of the present invention was prepared.

Example 16

The procedure for preparation of the recording material in Example 10 was repeated except that the erasure promoter was replaced with an erasure promoter having the following formula:

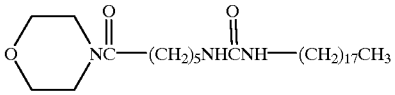

Thus, a reversible thermosensitive recording material of the present invention was prepared.

Example 17

The procedure for preparation of the recording material in Example 10 was repeated except that the erasure promoter was replaced with an erasure promoter having the following formula:

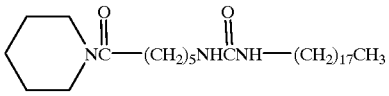

Thus, a reversible thermosensitive recording material of the present invention was prepared.

Example 18

The procedure for preparation of the recording material in Example 10 was repeated except that the erasure promoter was replaced with an erasure promoter having the following formula:

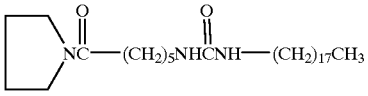

Thus, a reversible thermosensitive recording material of the present invention was prepared.

Comparative Example 1

The procedure for preparation of the recording material in Example 5 was repeated except that the erasure promoter was eliminated from the recording layer coating liquid and the color developer was replaced with the following color developer:

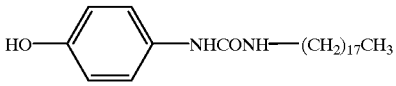

Thus, a comparative reversible thermosensitive recording material of the present invention was prepared.

Comparative Example 2

The procedure for preparation of the recording material in Example 5 was repeated except that the erasure promoter was replaced with an erasure promoter having the following formula:

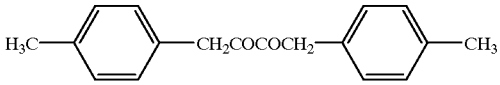

Thus, a comparative reversible thermosensitive recording material of the present invention was prepared.

(Image Recording Method)

An image was recorded in each of the thus prepared recording materials using a thermal image recording apparatus, manufactured by Ohkura Electric Co., Ltd., under the conditions that the voltage applied to a thermal printhead was 13.3 v and the pulse width was 1.2 ms. The image density of the recorded image was measured with Macbeth reflection densitometer RD914. In addition, the recorded image was then erased by heating at 110° C. for 1 second using a heat gradient tester manufactured by Toyo Seiki Co., Ltd. The residual image density was determined by the following equation:

$$\text{Residual image density} = IDr - GD$$

wherein IDr represents a reflection density of a portion of a recording material in which an image has been recorded and then erased, and GD represents a background density of the recorded image in the recording layer. The densities of IDr and GD were also measured with the reflection densitometer mentioned above.

In addition, the image density and the ground density of the recorded image were measured and then the image was preserved in a dry place at 50° C. for 24 hours. The image density and the ground density of the image were also measured after the preservation test to determine image density retention, which is obtained by the following equation:

$$\text{Image density retention}(\%) = \frac{(ID2 - GD2)}{(ID1 - GD1)} \times 100$$

wherein ID1 and ID2 represent image density of an image before and after the recording material having the image is preserved at 50° C. for 24 hours, respectively, and GD1 and GD2 represent background density of an image before and after the recording material having the image is preserved at 50° C. for 24 hours, respectively.

The results are shown in Table 23.

TABLE 23

| | Image Density | Residual image density | Image density retention (%) |
|---|---|---|---|
| Example 1 | 1.07 | 0.02 | 82 |
| Example 2 | 1.12 | 0.02 | 80 |
| Example 3 | 1.01 | 0.02 | 86 |
| Example 4 | 1.04 | 0.01 | 79 |
| Example 5 | 0.95 | 0.01 | 94 |
| Example 6 | 0.98 | 0.02 | 80 |
| Example 7 | 0.99 | 0.02 | 85 |
| Example 8 | 0.92 | 0.02 | 98 |
| Example 9 | 0.94 | 0.01 | 91 |
| Example 10 | 1.02 | 0.01 | 99 |
| Example 11 | 1.08 | 0.02 | 105 |
| Example 12 | 1.09 | 0.02 | 107 |
| Example 13 | 1.09 | 0.02 | 107 |
| Example 14 | 1.10 | 0.01 | 104 |
| Example 15 | 1.12 | 0.01 | 105 |
| Example 16 | 1.09 | 0.01 | 102 |
| Example 17 | 1.08 | 0.01 | 107 |
| Example 18 | 1.06 | 0.01 | 104 |
| Comparative Example 1 | 1.00 | 0.12 | 30 |
| Comparative Example 2 | 1.03 | 0.08 | 60 |

As can be understood from Table 23, the reversible thermosensitive recording material of the present invention has low residual density and high image density retention. Namely, the recording material of the present invention has quick erasability and the recorded images have good preservation properties.

Additional modifications and variations of the present invention are possible in light of the above teachings. It is therefore to be understood that within the scope of the appended claims the invention may be practiced other than as specifically described herein.

This document claims priority and contains subject matter related to Japanese Patent Applications Nos. 10-290125 and 10-309520, filed on Sep. 29, 1998 and Oct. 16, 1998, respectively, the entire contents of which are herein incorporated by reference.

What is claimed is:

1. A reversible thermosensitive recording material comprising a recording layer which is formed overlying at least one side of a substrate and which comprises an electron donating coloring agent and an electron accepting color developer, wherein the recording layer achieves a colored state when heated at a temperature not lower than an image forming temperature and then cooled at a cooling speed, and the recording layer in the colored state achieves a non-colored state when heated at a temperature lower than the image forming temperature and not lower than an image erasing temperature, or when heated at a temperature not lower than the image forming temperature and then cooled at a cooling speed relatively slow compared to the first-mentioned cooling speed, and wherein the recording layer further comprises an erasure promoter including one or more secondary amide groups having a formula selected from the group consisting of the following formulas (1), (2) and (3):

(1)

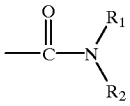

(2)

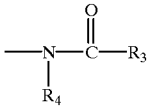

(3)

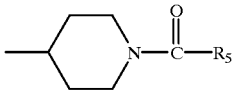

wherein each of R1, R2, R3, R4 and R5 independently represents a hydrocarbon group which is optionally substituted and which may be saturated or unsaturated, and wherein R1 and R2 are optionally combined to form a ring which may include one or more of a nitrogen atom, an oxygen atom and a sulfur atom.

2. The reversible thermosensitive recording material according to claim 1, wherein the erasure promoter comprises an alkyl chain having 6 or more carbon atoms and one or more of said secondary amide groups.

3. The reversible thermosensitive recording material according to claim 1, wherein the erasure promoter includes two or more of said secondary amide groups.

4. The reversible thermosensitive recording material according to claim 3, wherein the erasure promoter has a formula selected from the group consisting of the following formulas (4'), (5') and (6'):

(4')

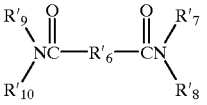

-continued (5')

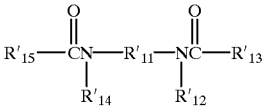

(6')

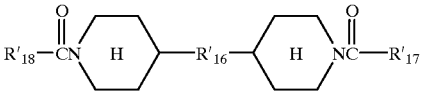

wherein each of R6', R7', R8', R9', R10', R11', R12', R13', R14', R15', R16', R17' and R18' independently represents a hydrocarbon group which is optionally substituted and which may be saturated or unsaturated, and wherein R7' and R8', and R9' and R10' are independently and optionally combined to form a ring which may include one or more of a nitrogen atom, an oxygen atom and a sulfur atom.

5. The reversible thermosensitive recording material according to claim 1, wherein the erasure promoter includes at least one group having an association ability.

6. The reversible thermosensitive recording material according to claim 5, wherein the group having an association ability comprises a group having a formula selected from the group consisting of the following formulas (4), (5) and (6).

(4)

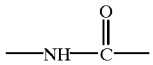

(5)

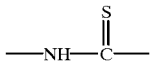

(6)

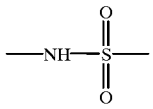

7. The reversible thermosensitive recording material according to claim 1, wherein the recording layer further comprises a color formation/erasure controlling agent including a divalent group having a hetero atom and an alkyl chain having 6 or more carbon atoms.

8. The reversible thermosensitive recording material according to claim 1, wherein the electron accepting color developer comprises a phenolic compound including an alkyl chain having 8 or more carbon atoms.

9. The reversible thermosensitive recording material according to claim 1, wherein the recording layer further comprises a crosslinked resin.

10. The reversible thermosensitive recording material according to claim 9, wherein the crosslinked resin is crosslinked with an isocyanate compound.

11. The reversible thermosensitive recording material according to claim 1, wherein the recording material further comprises a layer which is formed overlying the recording layer and which comprises an ultraviolet absorbent.

12. The reversible thermosensitive recording material according to claim 1, wherein the recording material further comprises a protective layer which is formed overlying the recording layer and which comprises a crosslinked resin.

13. The reversible thermosensitive recording material according to claim 1, wherein the recording material further comprises a magnetic recording layer.

14. The reversible thermosensitive recording material according to claim 1, wherein the recording material is card shaped or sheet shaped.

15. The reversible thermosensitive recording material according to claim 1, wherein the recording material further comprises a print layer which is formed overlying at least one side of the substrate.

16. A reversible thermal image recording/erasing method comprising the steps of:

providing a reversible thermosensitive recording material which comprises a substrate, a recording layer which is formed overlying at least one side of the substrate and which comprises an electron donating coloring agent and an electron accepting color developer, said recording material optionally further comprising any one or more of a protective layer which is formed overlying the recording layer, a layer including an ultraviolet absorbent which is formed overlying the recording layer, a magnetic recording layer and a print layer, wherein the recording layer achieves a colored state when heated at a temperature not lower than an image forming temperature and then cooled at a cooling speed, and the recording layer in the colored state achieves a non-colored state when heated at a temperature lower than the image forming temperature and not lower than an image erasing temperature or when heated at a temperature not lower than the image forming temperature and then cooled at a cooling speed relatively slow compared to the first-mentioned cooling speed, and wherein the recording layer further comprises an erasure promoter including one or more secondary amide groups having a formula selected from the group consisting of the following formulas (1), (2) and (3):

(1)

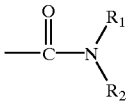

(2)

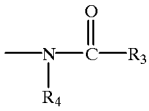

(3)

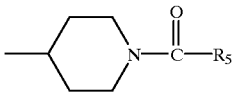

wherein each of R1, R2, R3, R4 and R5 independently represents a hydrocarbon group which is optionally substituted and which may be saturated or unsaturated, and wherein R1 and R2 are optionally combined to form a ring which may include one or more of a nitrogen atom, an oxygen atom and a sulfur atom, imagewise heating the recording layer at a temperature not lower than the image forming temperature and then cooling the recording layer at the first-mentioned cooling speed to form a colored image in the recording layer; and heating the recording layer at a temperature lower than the image forming temperature and not lower than the image erasing temperature to erase the image.

17. A reversible thermal image recording/erasing apparatus comprising:

an image forming device which imagewise heats a recording layer of a reversible thermosensitive recording material at a temperature not lower than an image forming temperature to form a colored image, wherein the recording material comprises an electron donating coloring agent and an electron accepting color developer in the recording layer and optionally further comprises any one or more of a protective layer, a layer including an ultraviolet absorbent which is formed overlying the recording layer, a magnetic layer and a print layer, and wherein the recording layer achieves a colored state when heated at a temperature not lower than the image forming temperature and then cooled at a cooling speed, and the recording layer in the colored state achieves a non-colored state when heated at a temperature lower than the image forming temperature and not lower than an image erasing temperature or when heated at a temperature not lower than the image forming temperature and then cooled at a cooling speed relatively slow compared to the first-mentioned cooling speed, and wherein the recording layer further comprises an erasure promoter including one or more secondary amide groups having a formula selected from the group consisting of the following formulas (1), (2) and (3):

(1)

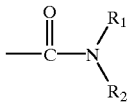

(2)

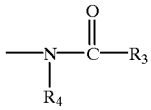

(3)

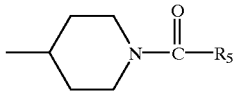

wherein each of R1, R2, R3, R4 and R5 independently represents a hydrocarbon group which is optionally substituted and which may be saturated or unsaturated, and wherein R1 and R2 are optionally combined to form a ring which may include one or more of a nitrogen atom, an oxygen atom and a sulfur atom; and an image erasing device which heats the recording layer at a temperature lower than the image forming temperature and not lower than the image erasing temperature to erase the colored image, wherein the image erasing device is one of heaters selected from the group consisting of ceramic heaters, plane heaters, and heat rollers.

* * * * *